US011559458B2

(12) United States Patent
Lukinuk et al.

(10) Patent No.: US 11,559,458 B2
(45) Date of Patent: Jan. 24, 2023

(54) CERVICAL-CURVATURE AUTOCORRECT APPARATUS AND METHODS INCORPORATING THE APPARATUS

(71) Applicant: ARC OF LIFE INC., Peterborough (CA)

(72) Inventors: Douglas George Lukinuk, Peterborough (CA); Kirk Anthony Johnson, Peterborough (CA); Richard Paul Schumacher, Kitchener (CA)

(73) Assignee: Arc of Life Inc., Peterborough (CA)

( * ) Notice: Subject to any disclaimer, the term of this patent is extended or adjusted under 35 U.S.C. 154(b) by 571 days.

(21) Appl. No.: 16/697,474

(22) Filed: Nov. 27, 2019

(65) Prior Publication Data

US 2020/0170871 A1 Jun. 4, 2020

Related U.S. Application Data

(60) Provisional application No. 62/773,331, filed on Nov. 30, 2018.

(51) Int. Cl.
*A61H 1/00* (2006.01)
*A61H 15/02* (2006.01)

(52) U.S. Cl.
CPC ..... *A61H 1/008* (2013.01); *A61H 15/02* (2013.01); *A61H 2201/0207* (2013.01);
(Continued)

(58) Field of Classification Search
CPC .... A61H 1/008; A61H 1/0292; A61H 1/0296; A61H 2201/1609; A61H 2201/1611;
(Continued)

(56) References Cited

U.S. PATENT DOCUMENTS 3,939,826 A 2/1976 Fujimoto
5,741,218 A 4/1998 Fujii
(Continued)

FOREIGN PATENT DOCUMENTS

CN 2566829 8/2003
CN 2566830 8/2003
(Continued)

OTHER PUBLICATIONS

Machine Translation of KR 10-2017-0027055 A (Lee Gwui Seon) Mar. 9, 2017.

(Continued)

*Primary Examiner* — Margaret M Luarca
*Assistant Examiner* — Cana A Gallegos
(74) *Attorney, Agent, or Firm* — Joseph F. Murphy; Potomac Law Group, PLLC

(57) ABSTRACT

An apparatus for manipulating (in one alternative correcting) the cervical curvature of a user, the apparatus having a top, a bottom, a first end, a second end, a first side and a second side, wherein: proximate the top, a thoracic section for receiving the upper back region of a user, preferably for receiving the thoracic region of the user; proximate the top, a cervical section for receiving the cervical curve region of the user; the cervical section is movable with a traction path in at least one of the following planes vertical, horizontal and combinations thereof; in one alternative, the cervical section is movable in an arc-like motion along the vertical plane.

27 Claims, 25 Drawing Sheets

(52) U.S. Cl.
CPC .. *A61H 2201/0214* (2013.01); *A61H 2201/10* (2013.01); *A61H 2201/169* (2013.01); *A61H 2201/1676* (2013.01); *A61H 2201/5002* (2013.01)

(58) Field of Classification Search
CPC ..... A61H 2201/1614; A61H 7/007; A61H 2007/009; A47G 9/1009
See application file for complete search history.

(56) References Cited

U.S. PATENT DOCUMENTS

| | | | | |
|---|---|---|---|---|
| 7,108,669 | B2 | 9/2006 | Huang | |
| 7,306,570 | B1 * | 12/2007 | Julian | A61H 7/007 601/134 |
| 8,414,510 | B2 | 4/2013 | Wu et al. | |
| 2003/0199796 | A1 * | 10/2003 | Yamazaki | A61H 7/007 601/134 |
| 2008/0045869 | A1 * | 2/2008 | Jones | A61H 15/0078 601/97 |
| 2008/0177212 | A1 * | 7/2008 | Kim | A61H 15/00 602/33 |
| 2011/0004131 | A1 * | 1/2011 | Han | A61H 7/007 601/112 |
| 2018/0049938 | A1 * | 2/2018 | Fleming | A61H 7/001 |
| 2018/0193222 | A1 | 7/2018 | Hotchkiss et al. | |
| 2019/0015235 | A1 * | 1/2019 | Badger | A61H 23/02 |

FOREIGN PATENT DOCUMENTS

| | | | |
|---|---|---|---|
| CN | 2780172 | | 5/2006 |
| CN | 2885225 | | 4/2007 |
| CN | 104490564 | A | 4/2015 |
| CN | 205054791 | | 3/2016 |
| CN | 206026508 | U | 3/2017 |
| CN | 106943284 | A | 7/2017 |
| CN | 105125388 | A | 12/2017 |
| CN | 106236561 | A | 12/2018 |
| JP | 2008194424 | A | 8/2008 |
| KR | 20070100623 | A | 10/2007 |
| KR | 10-2017-0027055 | A | 3/2017 |
| WO | 2011/102578 | A1 | 8/2011 |

OTHER PUBLICATIONS

Machine Translation of WO 2011/102578 A1 (Park Jang-Ho) Aug. 25, 2011.
Machine Translation of CN 206026508 U (Zheng Ziangang) Mar. 22, 2017.
International Search Report for PCT/CA2019/051693 dated Feb. 20, 2020.

* cited by examiner

Examples of Cervical Curvature Irregularities

LOC - Loss of Curve

CERVICAL-CURVATURE AUTOCORRECT APPARATUS AND METHODS INCORPORATING THE APPARATUS

FIELD OF THE DISCLOSURE

A massage and spinal corrective device allowing for restoring and correcting the cervical curvature of the first seven vertebrae of a mammalian spine. In particular the region which begins directly below the mammalian skull at the atlas vertebrae and ends above the thoracic spine. There is also provided a neuro-corrective device for restoring and/or improving neurological function of the central or peripheral nervous system thru hands on manipulation or non-surgical mechanical intervention. The device may also alleviate pressure, stress, and strain, from the spinal cord, and spinal nerve roots, while decreasing degeneration, restoring normal biomechanics, and releasing pressure from the suboccipital triangle, and associated cervical musculature. The device may also traction the cervical spine and reach down into the thoracic and lumbar regions of the body to alleviate, preferably correct any abnormalities therein. The device may also positively affect multiple organ systems over time. The device may further release blocked acupressure points proximate the spine releasing blocked chi or life-force energy allowing the chi or life-force energy to travel throughout the body more freely.

This disclosure relates to an apparatus to relieve headaches, neck pain and migraines, and numbness and tingling of the upper extremities. The apparatus comprises a back wedge with a rotating massager that aids in the compression of the cervical spine lordosis, and includes passive range of motion targeted at the suboccipital triangle. The apparatus further comprises a cradle including suboccipital lifters, which lift the suboccipital region while restoring the vertebral discs to their appropriate position while allowing hydration of the cervical discs. The apparatus provides massage therapy, as well as manual traction and extension to the neck. This enables users to reduce neck pain, headaches and migraines in the comfort of their residence, as well as assisting in correcting any underlying structures of the neck region that may cause neck pain, headaches and migraines, numbness and tingling of the upper extremities and further emulates the hand movements of a chiropractor, massage therapist or other professional.

CROSS-REFERENCE TO RELATED APPLICATIONS

This utility application claims the benefit under 35 U.S.C. § 119(e) of Provisional Application Ser. No. 62/773,331 filed on Nov. 30, 2018 entitled Cervical-Curvature Autocorrect Apparatus and Methods Incorporating the Apparatus. The entire disclosure of this provisional application is incorporated by reference herein.

BACKGROUND

Many people suffer from a variety of medical conditions. Some of the more common ailments are headaches, migraines, neck pain, arthritis, and arm or hand numbness, tingling and pain. Many individuals suffer from these ailments, which can interfere with their daily lives. It may be expensive or inconvenient to regularly visit a chiropractor or massage therapist to treat these problems. Medications offer a temporary aid rather than helping to correct the problem, and can lead to health problems over time.

The primary areas of a mammalian Central Nervous System (CNS) are the brain and spinal cord. The Cervical Spine (a.k.a. the neck) has one of the richest areas of proprioceptors and mechanoreceptors that are required, along with oxygen and glucose to "fuel" your brain. The top two spinal vertebrae in the neck are the atlas and the axis, which help protect the base of your brain (brain stem). Misalignments (subluxations) in this area can potentially affect the function of every organ in your entire body. Mental impulses are sent from your brain through a forward curve in your cervical spine. This curve is seen from a lateral x-ray of your neck. Because of its impact and importance, neurosurgeons and chiropractors call this curve "The Arc of Life." The cervical curvature should be at 42-45 degrees and any loss of your normal arc (or arch) of life—such loss being defined as anything less than or greater than the normal range of from about 42 to about 45 degrees—is considered a neurological problem, as it will apply pressure on the base of your brain, stretch your spinal cord and compress your nerves. Loss of your normal arc will also accelerate the spinal decay and degeneration process. Progressive loss of arc (or arch) in the cervical spine results in: degeneration of nerve fibers leading to organ failure; chronic compression of the spinal cord; and decreased blood flow through the associated arteries which may lead to stroke or decreased lifespan and/or death. A reversed cervical curve or "kyphosis" has been shown in studies to decrease life span up to 14 years and increase all age mortality up to 40%.

Currently billions of people worldwide suffer with chronic headaches, migraines and forward head posture from using devices such as cell phones and computers. Medicine has little to offer except medications to temporarily relieve pain but not correct the root structural and postural causes of the pain. These medications also come with a host of dangerous side effects. Chiropractors, massage therapists, and physiotherapists use many modalities to relieve pain and sometimes correct the underlying cervical curvature and postural problems, however, the cost of repetitive visits may be unaffordable for many people.

Attempts to correct the underlying abnormal curve of the cervical spine towards normal curvature have been tried using static wedges, tractioning devices, hands on manipulation and stretching. The cost of visits to professionals, discomfort associated with static tractioning devices, inconsistency of homecare and ineffectiveness of stretch and massage are undesirable in relation to attempting to correct the cervical curve.

Chiropractic corrective care works by first relieving the tension or inflammation to the delicate nerves of the spine. This irritation to spinal nerves is the chief cause of spinal pain. Chiropractic adjustments are given to relieve the pressure placed on the nerves of the spine. This relationship between the spine and nervous system is the main focus of chiropractic treatment. Many patients consider chiropractic fees to be expensive and many medical plans do not cover the cost, or not enough of the cost, to complete the cervical correction needed.

Home static devices attempt to bring about cervical traction which is a light stretching action meant to relieve pressure on compressed vertebrae, while also maintaining the health and placement of spinal discs. Cervical traction devices are created to mimic the kind of neck traction care you'd receive from a physical therapist, and with the right application, these devices can be simple and effective tools for at-home spinal treatment. These static devices may provide temporary relief of pain but no correction of the cervical curvature. Consumers purchase these devices not knowing the product cannot fix the cervical curvature problem resulting in unnecessary loss of funds. Consumers unaware of their underlying problems purchase devices that can do more harm than good.

Massage therapy (including massage-motion or vibrating devices) helps ease neck pain. Massage is a popular therapy used to relieve muscle tension, spasms, inflammation, fluid retention, aches, stiffness, and pain. Massage increases circulation and warms muscles and other soft tissues (i.e., tendons, ligaments). Massage therapy is limited by temporary relief of pain but no manipulation of the spine nor correction of the cervical curvature. Massage therapy (including massage-motion or vibrating devices) has similar disadvantages as per chiropractic treatment above regarding lack of coverage from medical plans. Massage-motion and vibrating devices provide pleasure and relief to the problem area but little corrective effect resulting in poor compliance by the user.

Acupuncture/Acupressure—Acupuncture improves the body's functions and promotes the natural self-healing process by stimulating specific anatomic sites—commonly referred to as acupuncture points, or acupoints. The most common method used to stimulate acupoints is the insertion of fine, sterile needles into the skin. Acupressure is performed without needles; the stimulation of the points occurs using the arms, hands and fingers. Acupuncture and Acupressure techniques provide temporary relief of pain but no manipulation of the spine nor correction of the cervical curvature. Acupuncture/Acupressure has similar disadvantages as per chiropractic treatment above regarding lack of coverage from medical plans.

Muscle Energy Technique (MET)—Muscle Energy Technique (MET) is a form of a manual therapy that uses a muscle's own energy in the form of gentle isometric contractions to relax the muscles via autogenic or reciprocal inhibition, and lengthen the muscle to allow the spine to heal. As compared to static stretching which is a passive technique in which a therapist does all the work, MET is an active technique in which the patient is also an active participant. MET is based on the concepts of Autogenic Inhibition and Reciprocal Inhibition. While the repeated stretching and releasing of the muscles surrounding the cervical spine during MET does increase muscle length and relieve pressure on the cervical vertebrae relieving pain, it does not have the ability to correct the forward or other damaged neck postures. Unless performed by an osteopath or physiotherapist, this process is not well known and not covered under any medical plan. If performed by an osteopath or physiotherapist, MET suffers from similar disadvantages as per chiropractic treatment above regarding lack of coverage from medical plans.

There is a need for an apparatus allowing an individual to reduce headaches, migraines, neck pain, arthritis, and arm or hand pain without needing to visit a professional such as a chiropractor or massage therapist.

There is also a need for an apparatus allowing an individual to reduce headaches, migraines, neck pain, arthritis, and arm or hand pain without the need of medications.

There is also a need for an apparatus for correcting the underlying cervical curve and resulting subluxation of the cervical spine towards a normal healthy position.

There is also a need for an apparatus, which may stretch and massage the site in need of treatment to lengthen the neck muscles.

There is also a need for an apparatus, which may traction the spine to relieve pressure off the spinal cord.

There is also a need for an apparatus, which may release blocked nerves and subtle energy (aka chi/qi/prana/life-force energy: vital energy that is held to animate the body internally and is of central importance in some Eastern systems of medical treatment (such as acupuncture) and of exercise or self-defense (such as tai chi). As long as chi or prana flows freely and is balanced, health is maintained.).

There is also a need for an apparatus, which may assist in the process of repairing organs, glands and body systems damaged by prolonged misalignment of the cervical curve.

There is also a need for an apparatus, which may provide at least one of the following: correct posture, relieve cervical tension, impingement, migraines and headaches, allow unimpeded cerebral spinal fluid flow, restore the cervical arc to normal and combinations thereof.

There is also a need for an apparatus, which comprises a back wedge with a rotating massager aiding in compression of the cervical spine lordosis, and in one alternative provides for continuous passive range of motion, in one alternative said continuous passive range of motion is targeted at the suboccipital triangle.

There is also a need for an apparatus including a suboccipital lifter, in one alternative a plurality of suboccipital lifters, which lift the suboccipital region of the user while restoring the vertebral discs to a normal or structurally preferred position.

There is also a need for an apparatus, which provides at least one of, preferably at least two of, more preferably all of massage therapy, manual traction and extension to the neck of the user.

There is also a need for an apparatus, which enables a user to minimize, preferably eradicate at least one of, preferably a plurality of neck pain, headache and migraine effectively without the need to visit a professional (i.e. at home).

There is also a need for an apparatus, which corrects the underlying structures that cause at least one of, preferably a combination of neck pain, headache and migraine.

There is also a need for an apparatus, which emulates the hand movement of a chiropractor, massage therapist or other professional when treating the neck area of a user.

There is also a need for a method of correcting posture, in one alternative, the arc of life region (the suboccipital triangle between the cervical vertebrae and the base of the skull).

SUMMARY

The normal arc (or arch) is defined as from about 42 to about 45 degrees relative to an angle formed between two constructed lines: one along the major axis of C1, and the other along the inferior side of the body of C7, as shown in FIG. 12.

The term "arc" and "arch" are used herein interchangeably.

According to one aspect, there is provided an apparatus for manipulating (in one alternative correcting) the cervical curvature of a user, said apparatus comprising a top, a bottom, a first end, a second end, a first side and a second side, wherein:

proximate said top, a thoracic section for receiving the upper back region of a user, preferably for receiving the thoracic region of the user; said thoracic section in one alternative being stationary; in another alternative, said thoracic section is movable; in yet another alternative, said thoracic section is fixed proximate the first end and movable proximate said second end of said apparatus; proximate said top, further comprising a cervical section for receiving the cervical curve region of the user; in one alternative, said cervical section is movable with a traction path in at least one of the following planes vertical, horizontal and combinations thereof; in one alternative, said cervical section is movable in an arc-like motion along the vertical plane.

According to one alternative, said thoracic section further comprises an area adaptable to the weight of the user when said user's thoracic curvature area is in contact with said thoracic section of said apparatus. In one alternative, said area is pliable to allow a user to rest on said thoracic section without undue discomfort. In one alternative, said thoracic section comprises a sponge like section. In another alternative, said thoracic section comprises a foam like pad. In yet another alternative, said apparatus is movable in relation to the fixed end of the thoracic section to the cervical section between an angle of from 0 degrees to about 90 degrees relative to the bottom of the apparatus and the horizon.

According to yet another alternative, said cervical section further comprises at least one head, in one alternative at least two heads, in one alternative said at least two heads are spaced apart from each other along a horizontal plane resulting in a horizontal distance between each of said at least two heads. In one alternative, said horizontal distance between each of said at least two heads is adjustable from a first position to a second position. In one alternative, said horizontal distance between each of said at least two heads is adjustable from a first position to a plurality of second positions, along a horizontal plane.

According to yet another alternative, said at least one head, in one alternative, said at least two heads are adjustable in height from a first position to a second position, or a plurality of second positions. In one alternative, each of said at least two heads are individually adjustable exclusive of each other to a height of choice.

According to yet another alternative, said at least one head, in one alternative, said at least two heads are movable in a curve like motion, in one alternative an arc-like motion replicating the arc-like curvature of the cervical curvature when in a normal healthy condition. In one alternative, said curve like motion is from said first end to said second end of said cervical section of said apparatus. In another alternative, said curve like motion oscillates from said first end to said second and from said second end to said first end, in one alternative in an elliptical orbital. In one alternative, said curve like motion is generated by one or more motors connected, in one alternative by a pulley, to at least one gear, in one alternative to at least two gears, wherein said at least one gear, in one alternative each of said at least two gears is connected to said at least one head, in one alternative, to each of said at least two heads is connected to a link arm via a drive arm.

In one alternative, said apparatus is used with a patient in a substantially supine position. In another alternative, said apparatus is used with the user in a substantially upright position. In yet another alternative, said apparatus is used with the user in a Fowler's position. In yet another alternative, said apparatus is used with the user in between a supine position and a Fowler's position.

In one alternative, said at least one head comprises a shape selected from the group consisting of a hemisphere, a spherical cap (spherical dome), a hemiellipsoid, a cone, a roller wheel and combinations thereof. In one alternative, said at least one head has a textured surface. In yet another alternative, said at least one head is a u-shaped cradle. In yet another alternative, said at least one head is a horizontal cradle. In yet another alternative, said at least one head, preferably said at least two heads are made of material comprising, but not limited to, silicon, rubber, inflatable material, polyurethane, plastic, cell foam, gel, gel foam and combinations thereof. In yet another alternative, said at least one head has a Shore Hardness in the range of from about 10 to about 100. In yet another alternative, said cervical section comprises a plurality of heads oriented from said first end to said second end. In yet another alternative, said cervical section comprises a plurality of heads oriented from said first side to said second side. In yet another alternative, said cervical section comprises a plurality of heads oriented in both a first end to second end orientation and a first side to second side orientation. In yet another alternative, said at least one head, preferably said at least two heads, more preferably said plurality of heads further comprise characteristics to further stimulate and or massage the cervical region, including but not limited to vibration, temperature adjustment (heat/cold), electro-stimulation, rollers and combinations thereof.

In one alternative, said at least one head, in one alternative each of said at least two heads further comprises a degree of articulation, in one alternative longitudinal articulation, in another alternative lateral (or transverse) articulation, and in yet another alternative a combination of longitudinal and lateral (or transverse) articulation, allowing for angular adjustment of said at least one head, in one alternative each of said at least two heads to accommodate comfortability of the user. In one alternative, said degree of articulation is from 0° to about 45°.

In yet another alternative, said at least one head, in one alternative said at least two heads, in yet another alternative, said plurality of heads further comprise a piston allowing for a piston like action during the curve like motion thereof. In one alternative, said piston like action is substantially vertical. In another alternative, said piston like action is angular in relation to the vertical. In one alternative said piston like action is angular in relation to the vertical from 0° to about 30 degrees.

In yet another alternative, said traction path may have an arc radius of from about 42° to about 45° to mimic the arc of life curve. In another alternative, said traction path may have an arc radius of form about 0° to about 90° to improve cervical irregularities including but not limited to subluxation(s), spondylolisthesis, forward head posture (tech or text neck), ligamentous fibrosis, muscular adhesions, trigger points, disc herniations, disc bulges, radiculopathy, spinal and/or nerve root stenosis, cerebral spinal fluid disruption, scoliosis, kyphosis, military neck, sprain/strain, whiplash, and post concussion syndrome. In another alternative, said traction path may have an irregular radius controlled by two motors, one motor independently controlling a vertical curve like motion of the traction path and another motor independently controlling a horizontal motion of the traction path, said irregular radius allowing for targeting of different areas of the cervical spine corresponding with varying physiological needs and outcomes.

In yet another alternative, said traction path may be smooth, pulsing and combinations thereof. Although not being bound by theory, it is believed the smooth and pulsing traction path mimics chiropractic adjustment stimulations.

In yet another alternative, said traction path may be at a continuous speed, variable speed (including pauses during traction path travel) and combinations thereof. Although not being bound by theory, the arc radius and traction path simulate beyond arc of life cervical auto correction, other healthcare processes such as, but not limited to, Rolfing, myofascial stimulation (ART), acupressure point stimulation, cerebral spinal fluid flow, breathing rate and combinations thereof.

In one alternative, said motor is an electric motor. In another alternative, said electric motor has variable speed capability controllable by the user. In one alternative, said user may control the motor function via a control selected from an onboard control, a wired control, wireless control, Bluetooth control, mobile software application and combinations thereof.

In yet another alternative, said apparatus further comprises a control for controlling on/off function, speed options, tilting adjustment, vibration, heat, cold and combinations thereof.

In yet another alternative, said apparatus further comprises at least one headband connectable to said base proximate said cervical section of said apparatus. Said headband may comprise a strap, in one alternative a stretchable strap, with adjustable length, tension, width and combinations thereof. In another alternative, said apparatus further comprises a plurality of headbands. In yet another alternative, said at least one headband further comprises a heating element, cooling element and combinations thereof.

According to yet another alternative there is provided an apparatus to correct posture, relieve cervical tension, impingement, migraines and headaches and restore the cervical arc. The apparatus comprises a back wedge with a rotating massager that aids in the compression of the cervical spine lordosis, and includes continuous passive range of motion that is targeted at the suboccipital triangle. The massager further comprises a cradle, which includes suboccipital lifters, which lift the suboccipital region of the user while restoring the vertebral discs to their appropriate position. This provides massage therapy, as well as manual traction and extension to the neck. This enables users to eradicate neck pain, headaches and migraines effectively at home, corrects the underlying structures that cause neck pain, headaches and migraines, and emulates the hand movements of a chiropractor, massage therapist or other professional health practitioner.

According to yet another alternative, the repetitive, arched, massage-like motion of the apparatus is pleasing to the user and that feel-good experience along with the corrective action of the device repairing underlying conditions, improves compliance of the user to use the apparatus frequently.

According to yet another alternative, the apparatus provides continuous passive, repetitive, arched motion to the cervical spine in order to inexpensively massage the muscles and gently restore the cervical arc. The apparatus may also restore range of motion in the cervical spine region, decrease or eliminate pain and medication dependency, reduce or eliminate headache and migraines, correct posture "tech neck", and it may also improve the immune system, blood pressure, balance, tinnitus, decrease arthritis and disc bulges, as well as allow proper function of the nervous system and brain body communication pathways.

According to yet another alternative, the apparatus may release blocked acupressure points and meridians releasing blocked chi or life-force energy so the chi or life-force energy may travel throughout the body more freely.

DETAILED DESCRIPTION

Figure 1:
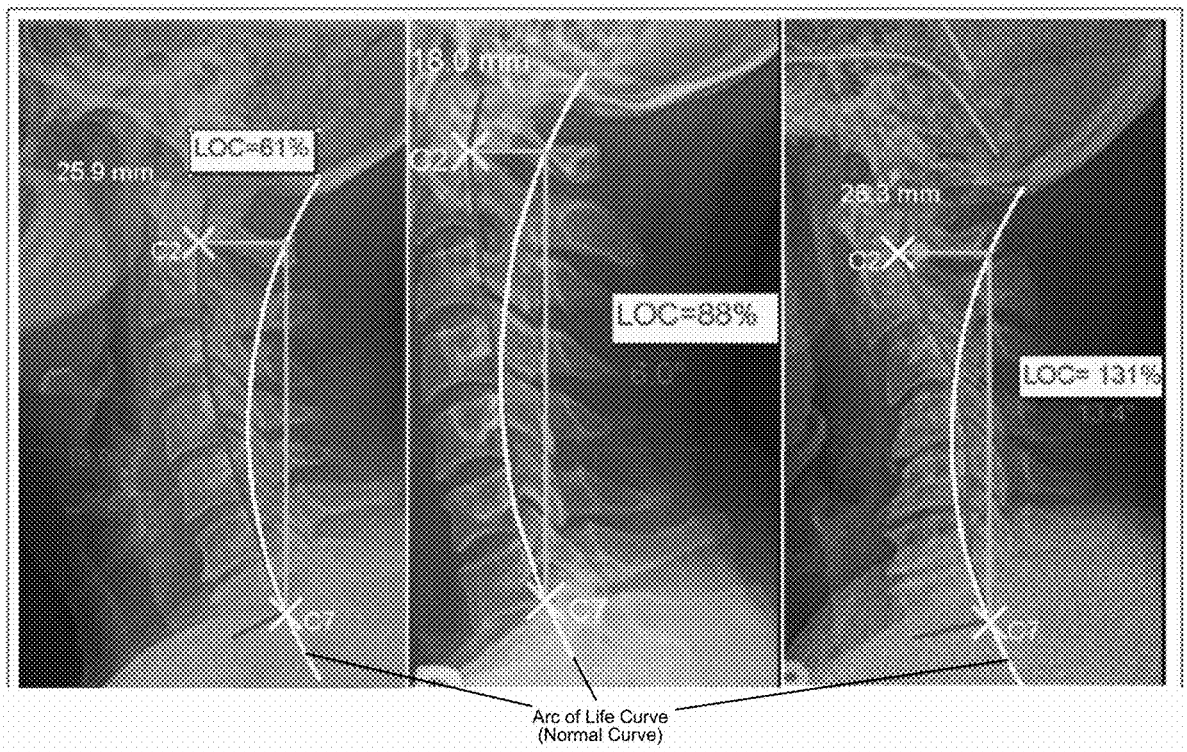
FIG. 1 is a view of several examples of cervical curvature irregularities.

Referring now to FIG. 1, there is depicted three instances of loss of curve (LOC) in the cervical region. In one instance, the LOC is 61% between cervical vertebrae C2 and C7. In another instance, the LOC is 88% and in a third instance, the LOC is 131%. LOC may lead to health issues as discussed above.

Figure 2:
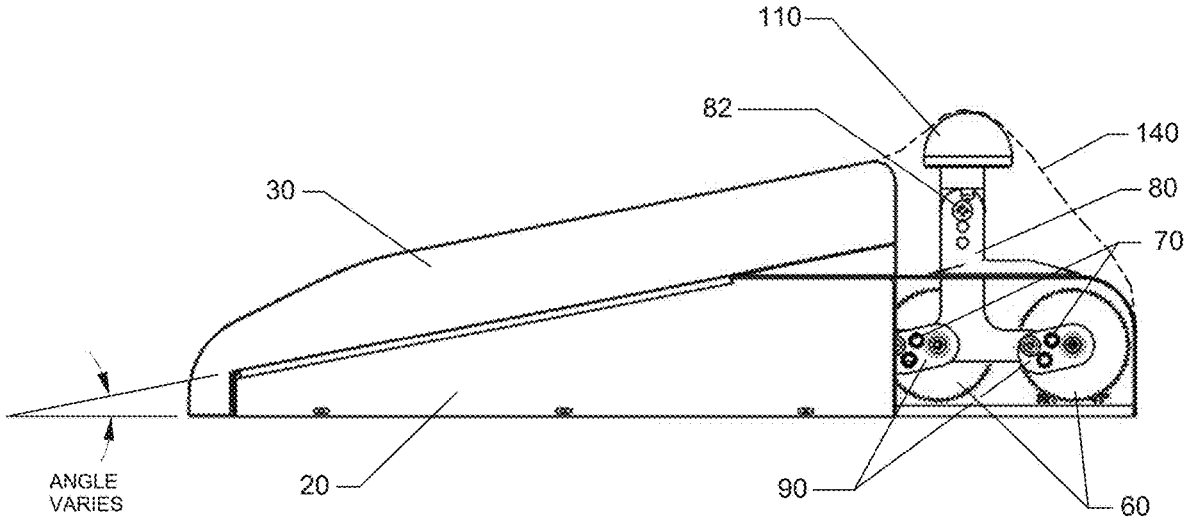
FIG. 2 is a side cutaway view of an apparatus, according to one alternative.
Figure 3:
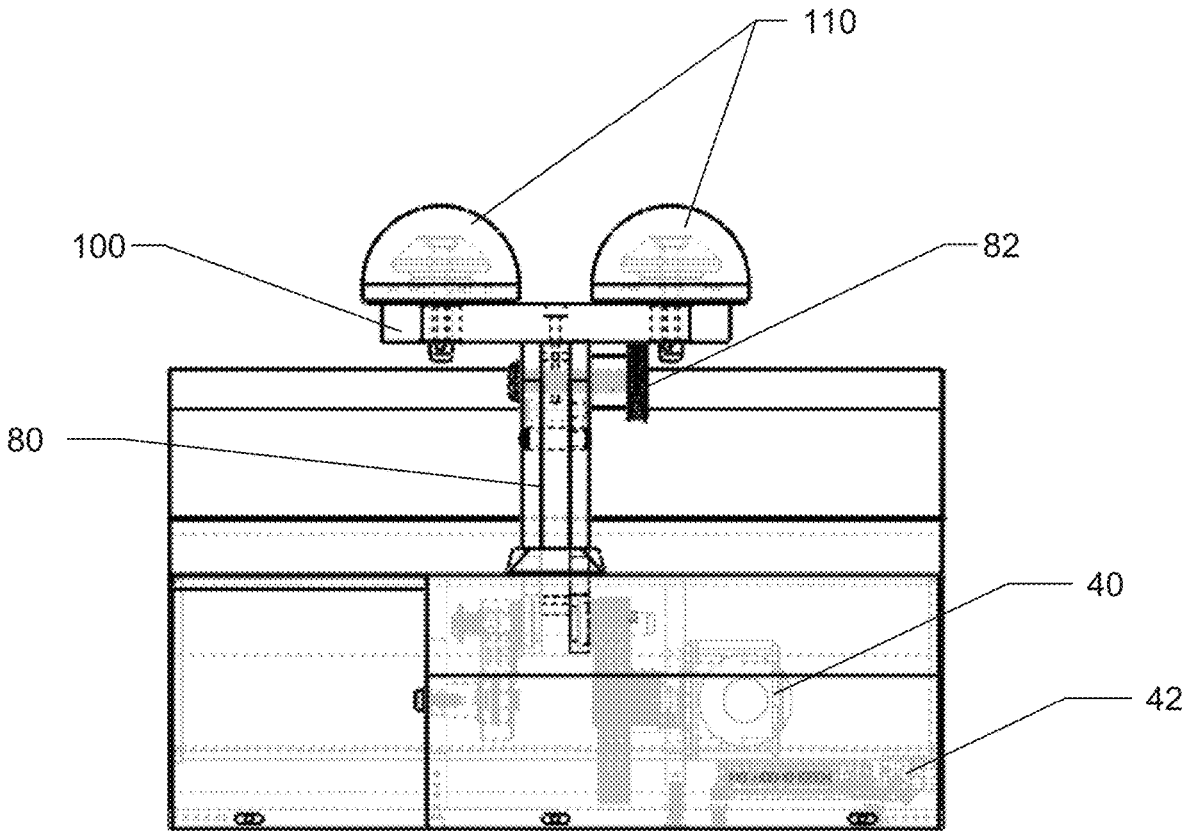
FIG. 3 is an end cutaway view of the apparatus, according to one alternative.
Figure 4:
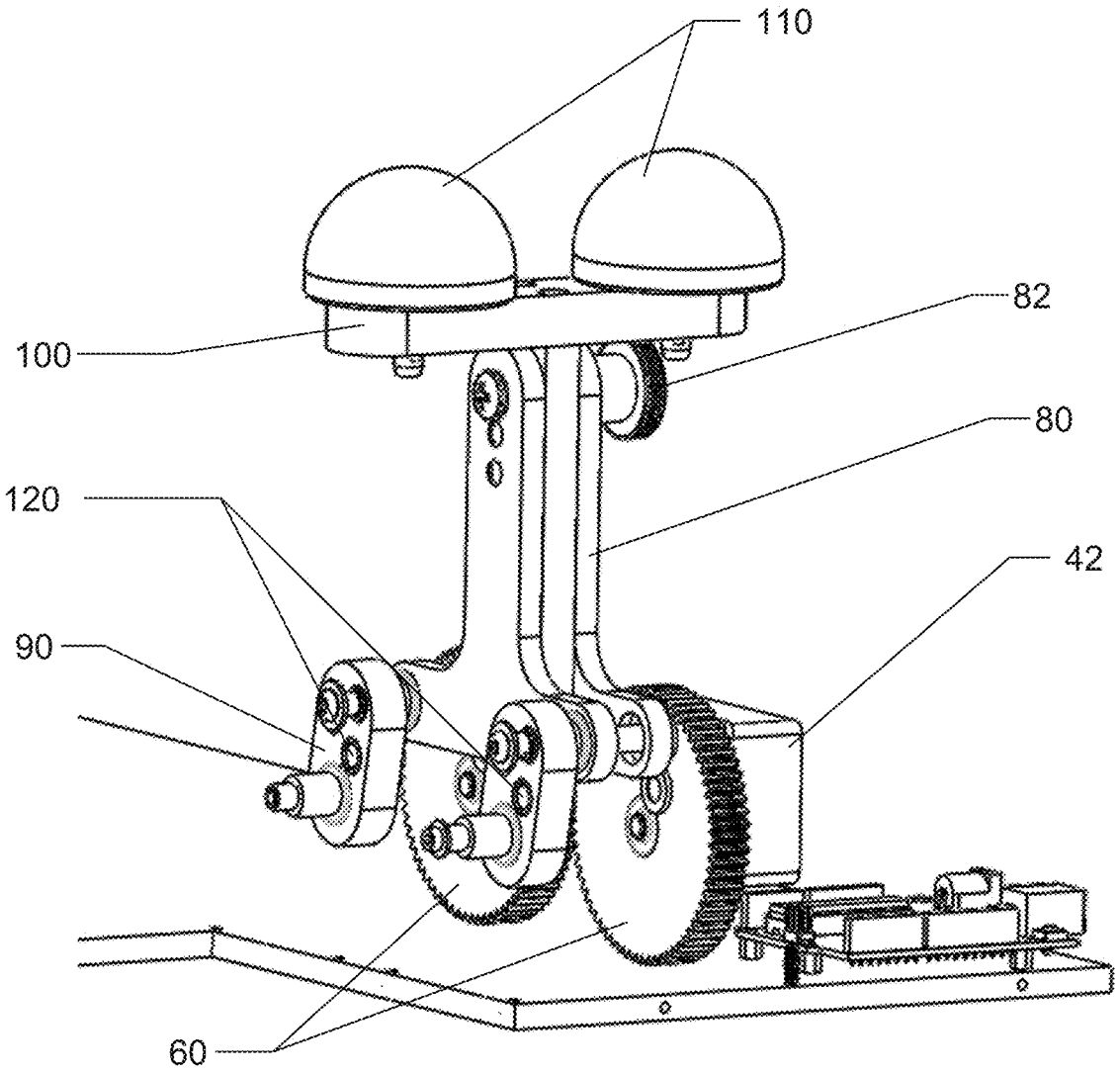
FIG. 4 is a perspective view of the gears and heads of the apparatus, according to one alternative.
Figure 5:
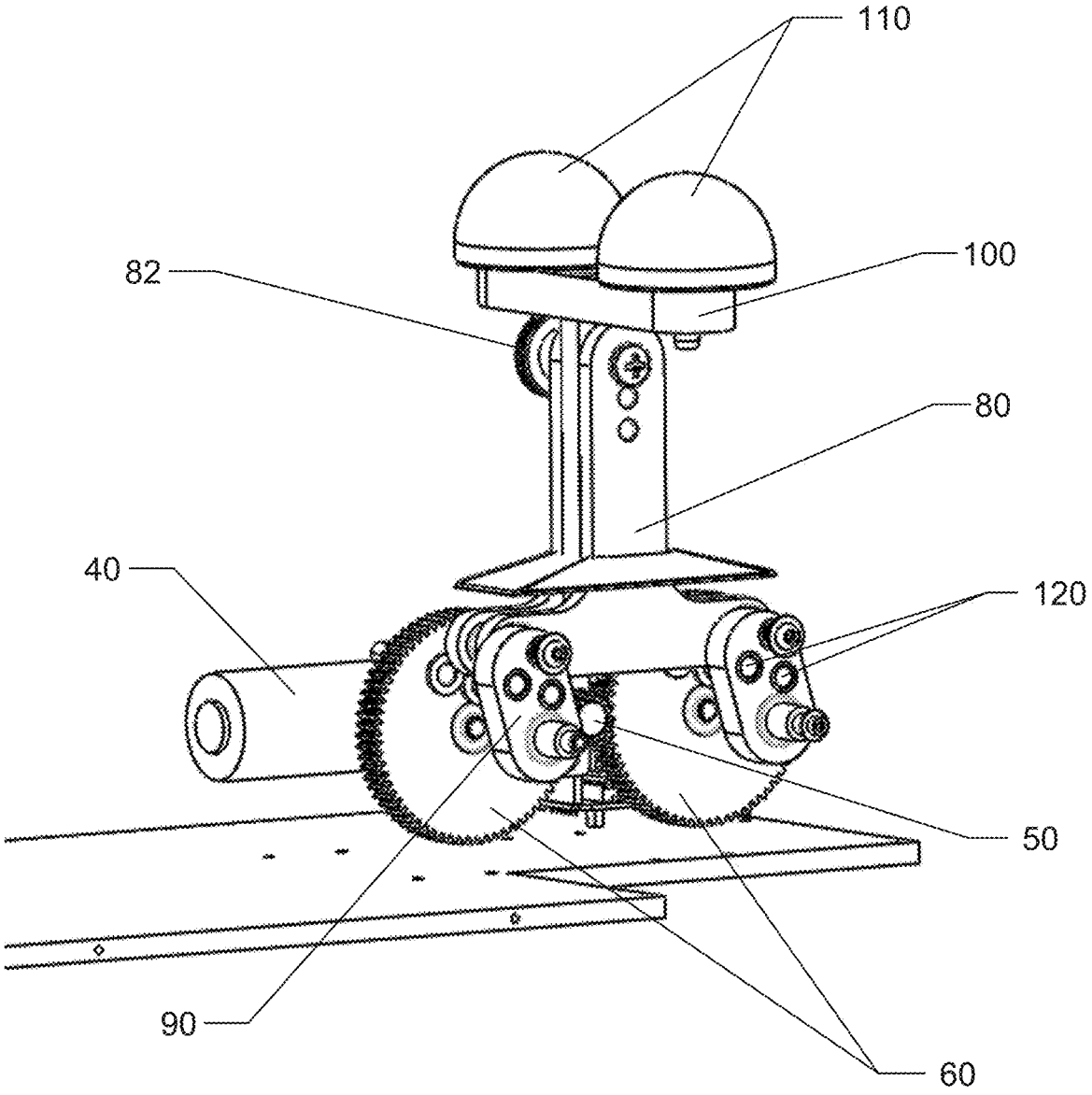
FIG. 5 is a side view of FIG. 4.
Figure 6:
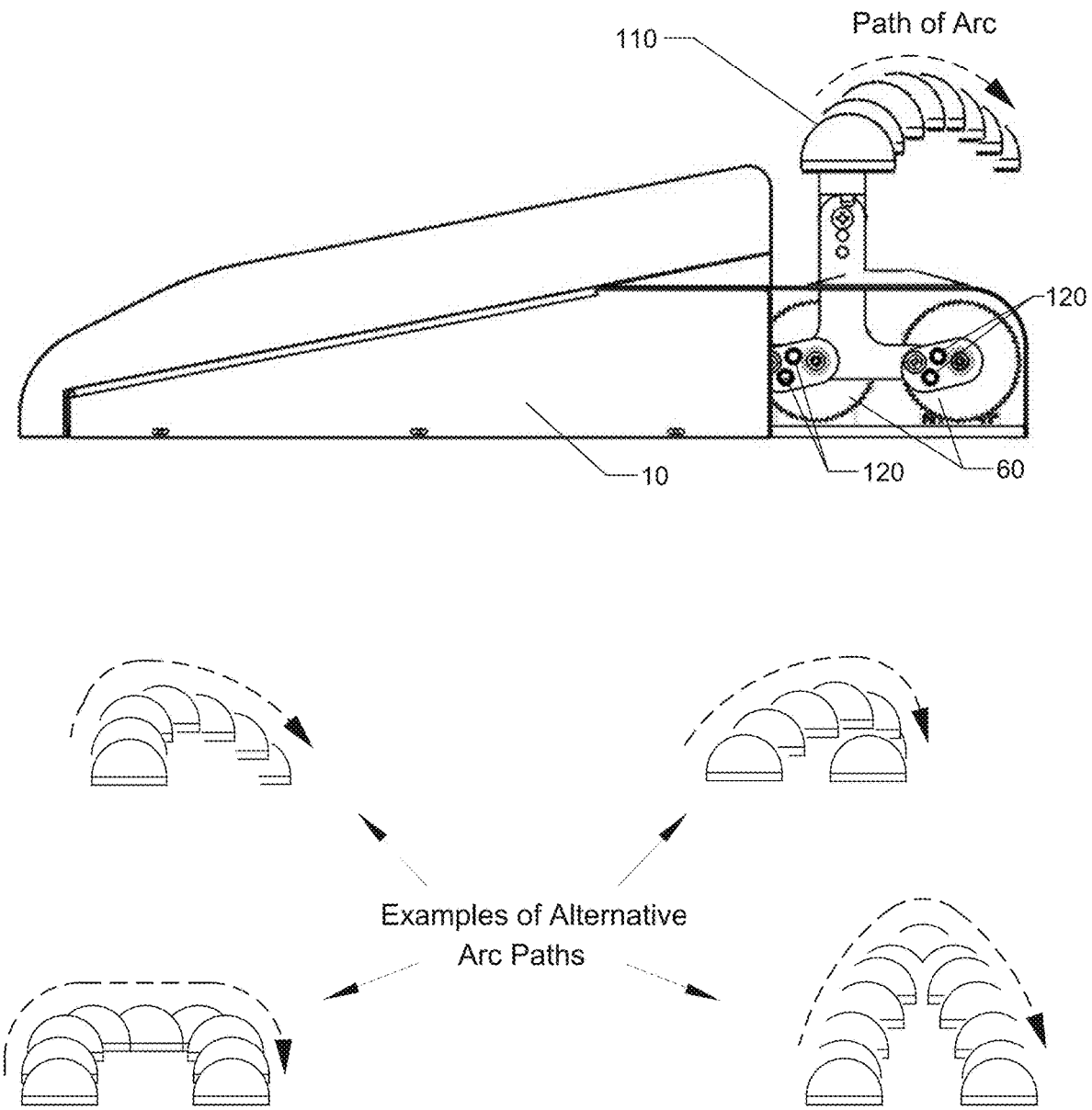
FIG. 6 is a side view of the apparatus depicting a traction path of the heads, in one alternative.
Figure 7:
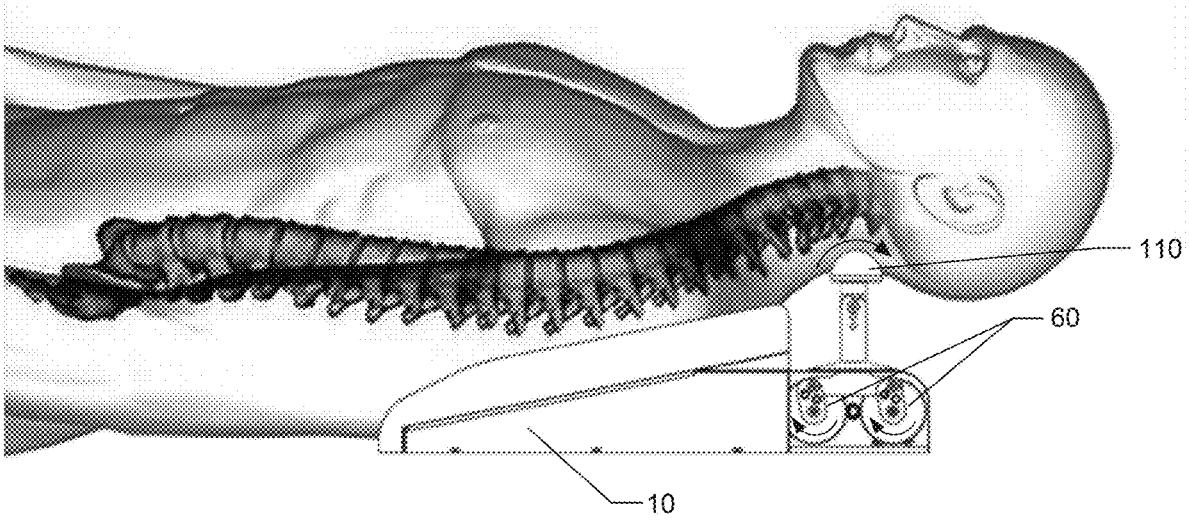
FIG. 7 is a view of a user in a supine position using the apparatus.

Referring now to FIGS. 2-5, there is depicted an apparatus 10 with a thoracic section, in this instance a wedge-shaped base 20, which may be angled, relative to the horizon, ranging from 0° to about 30°. The wedge-shaped base 20 is covered by a soft foam pad 30, which may be constructed of various materials, including but not limited to open cell foam and gel foam, to provide comfort and support to the user's thoracic area. An electric motor 40, is connected to a gear case 42, which turns a main drive gear 50. The main drive gear 50 engages with and turns two equally sized large gears 60, which are driven in synchronicity to provide balance and uniform power distribution from the motor 40. In one alternative, the system of gears may be replaced with a belt drive system. In yet another alternative, the system of gears may be replaced with a chain drive system. In yet another alternative, the motor 40 may be replaced by a combination of motors, which control vertical and horizontal motion independently to provide variable combinations of arc path patterns. A set of adjustable drive pins 70 are connected from the large gears 60 through a T-shaped link arm 80, and into a set of cam-shaped control arms 90. The control arms 90 rotate on lubricated bushings providing balance and even weight distribution when the apparatus 10 is operating with a user thereon. The T-shaped link arm 80 is driven by the large gears 60 via the adjustable drive pins 70. Sitting atop the T-shaped link arm 80 is an adjustable spreader bar 100, which holds two adjustable massage heads 110. As best seen in FIGS. 4-5, the moving parts of the apparatus 10 are powered by an electrical motor 40 with a driveshaft 50 that turns two large gears 60, which in turn cause the massage heads 110 to move in an arched plane along the patient's neck. Variability in the range of motion of the two adjustable massage heads 110 in a longitudinal and vertical direction may be achieved through adjustment of drive pins 70 in the various pre-established locations on control arms 90 and large gears 60. In one alternative, these adjustment pins 70 may be replaced with a different adjustment system. The T-shaped link arm 80 also contains a height adjustment element 82, which enables additional vertical height adjustment of the massage heads 110 in relation to the base 20. Each of the two massage heads 110 may be adjusted inward (toward each other) or outward (away from each other) along the spreader bar 100 to suit the characteristics and preferences of the patient. The spreader bar 100 may be fitted with a predetermined set of widths for the massage heads 110, or it may offer a variable width (between minimum and maximum settings) between each of the massage heads 110 as chosen by the user. The massage heads can be provided in varying shapes and sizes, materials, hardness, and with additional features such as heat and vibration. The patient or the practitioner controls the operation of the device with a handheld remote, either wired or wireless. As best seen in FIGS. 6 and 7, the device 10 is shown with one alternative arc path of the massage head 110 being driven by large gears 60. The arc path may be adjusted by adjusting adjustable drive pins 120. Alternative arc paths are shown in FIG. 6. As best seen in FIG. 2, an optional textile or fabric cover 140 may be used to cover the massage heads 110.

Figure 8:
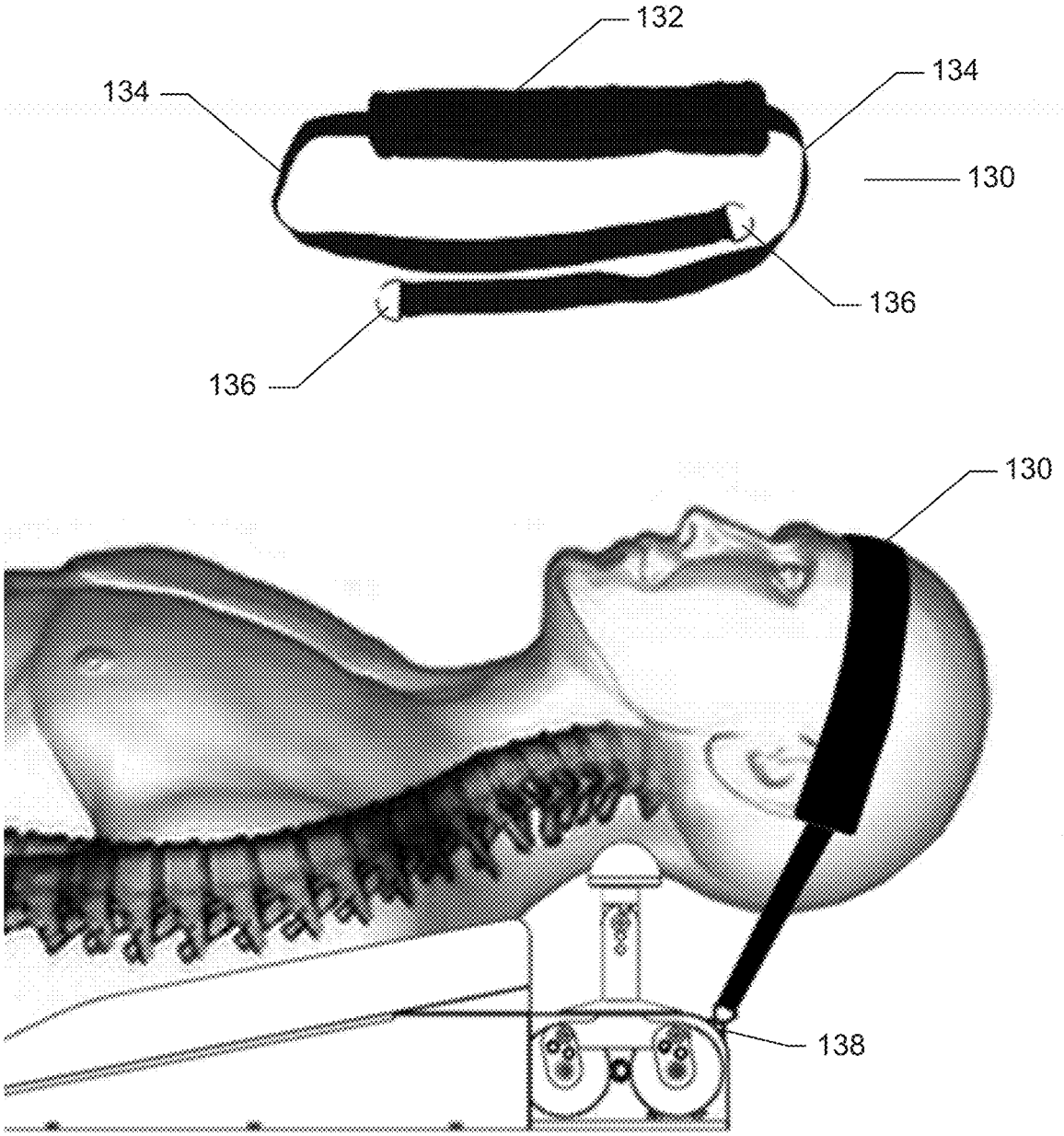
FIG. 8 depicts the use of the traction headband by a user in a supine position.

The device applies pressure on the suboccipital region with a pair of articular massage heads that sit paraspinally to alleviate headaches, migraines and neck pain, while correcting the underlying discs, cervical curvature and suboccipital musculature. The device lifts and extends the neck and head to take pressure off of discs and nerves correcting the underlying cause of neck and headache pain. In this way, the present invention provides a device that massages and applies pressure to the neck and head in a manner that emulates the hand techniques of a chiropractor or other professional. The device also has a form of headband to traction the head downwards creating force to alter the cervical curvature of the spine, thereby treating "tech neck or 'text neck" and restoring the cervical curve as shown in FIG. 8. This allows proper nerve flow from the brain to the body and body to the brain resulting in many possible physiological benefits including but not limited to blood pressure, immune system, headaches, migraines, blood flow, CSF flow, tinnitus, vertigo, numbness and tingling, neck and shoulder pain.

The apparatus provides at least one of the following:

continuous passive arced range of motion (CPAM);

automated home corrective device for the cervical curve;

interchangeable massage arm and curve corrective arm;

interchangeable massage and curve correction balls;

cushioned angular wedge for position to correct the cervical spine;

timed breathing rate with motion of the corrective device controls; and adjustable head strap to traction the cervical curve.

Referring now to FIG. 8, there is shown the apparatus 10 with a user incorporating a traction headband 130. One purpose of the traction headband is to traction the user's head downwards towards the base 20 of the apparatus 10 creating force to alter the cervical curvature of the spine, thereby treating "tech neck" or "text neck" and restoring the cervical curve. Another purpose of the traction headband 130 is to keep the user's neck in a stable position during operation of the apparatus 10. The traction headband 130 comprises a centrally located forehead portion 132 saddled on each side thereof by a connecting strap 134 for connecting the headband 130 to the base 20 of the apparatus 10. In one alternative, each connecting strap 134 includes a metal loop 136 for connection to a metal loop receiver 138 on the base 20. In another alternative, the headband 130 may be stretchable with adjustable length, tension and width. The headband 130 may also have features such as heat and cold temperature settings. Although a single headband is depicted, one may use more than one headband as required.

Figure 9:
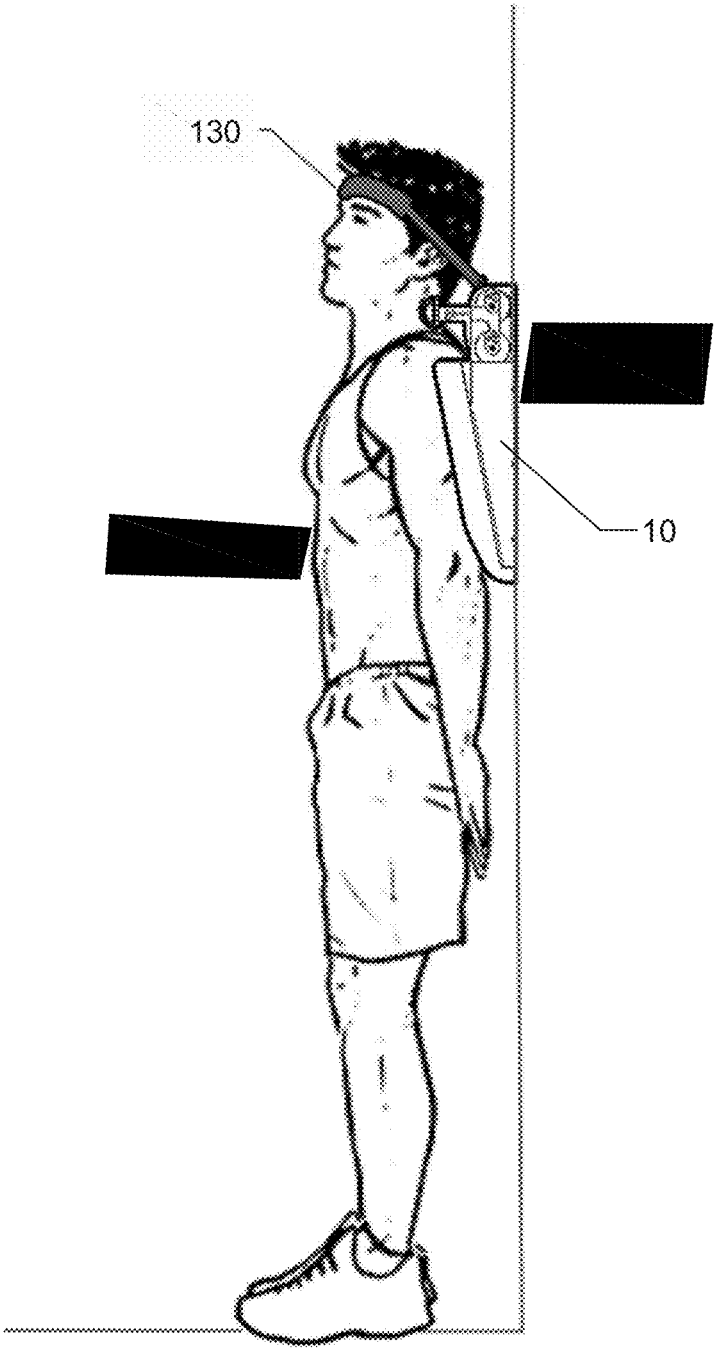
FIG. 9 depicts the user in an upright position using the apparatus.

The apparatus 10 may be used both vertically and horizontally. Horizontally, the apparatus 10 may be used by individuals laying down using the standalone unit, alternatively the apparatus 10 may be built into a support structure such as a table, or used in conjunction with a massage table or other table. Referring now to FIG. 9, the apparatus 10 is shown being used in a vertical orientation. Vertically, the apparatus 10 may be attached to a wall and used by individuals standing (depicted in FIG. 9) or sitting in a chair, or wheelchair. This position may be accomplished because the user's head is set in place using the traction headband 130.

Figure 10:
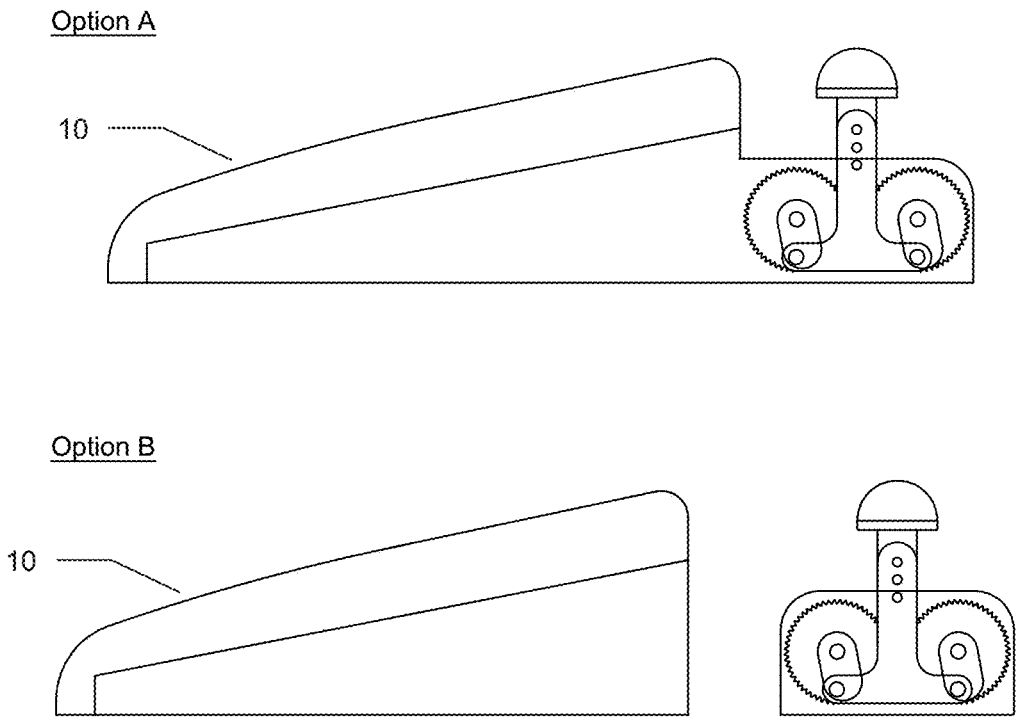
FIG. 10 depicts the apparatus in a unitary format and in a two piece detachable format.

Referring now to FIG. 10, the apparatus 10 may be constructed as a single unitary unit (Option A) or as a multi-piece detachable unit (Option B). In one alternative, the multi-piece detachable unit comprises the motorized section (cervical section) detachable from the wedge-shaped section (thoracic section).

Figure 11:
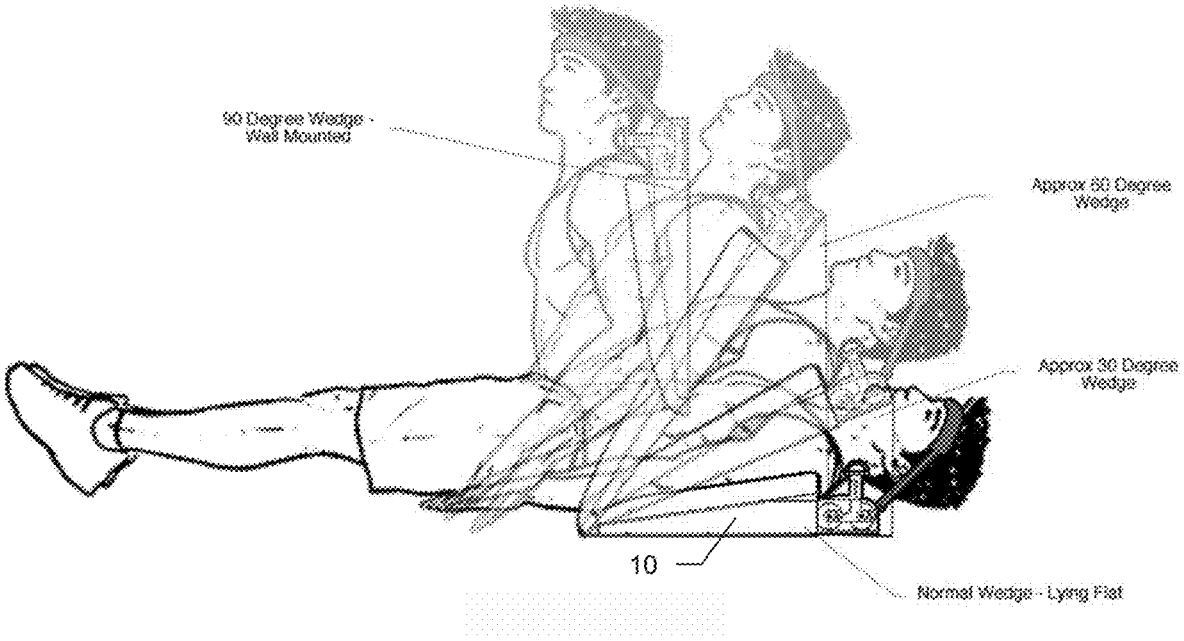
FIG. 11 depicts the user and the apparatus in various positions from supine to Fowler's position.

Referring now to FIG. 11, there is depicted the apparatus 10 and a user in various positions from a supine position to a Fowler's (or sitting) position. The angle of the apparatus relative to the horizon ranges from about 0° to about 90° with angles approaching 90° having the apparatus wall mounted.

Figure 12:
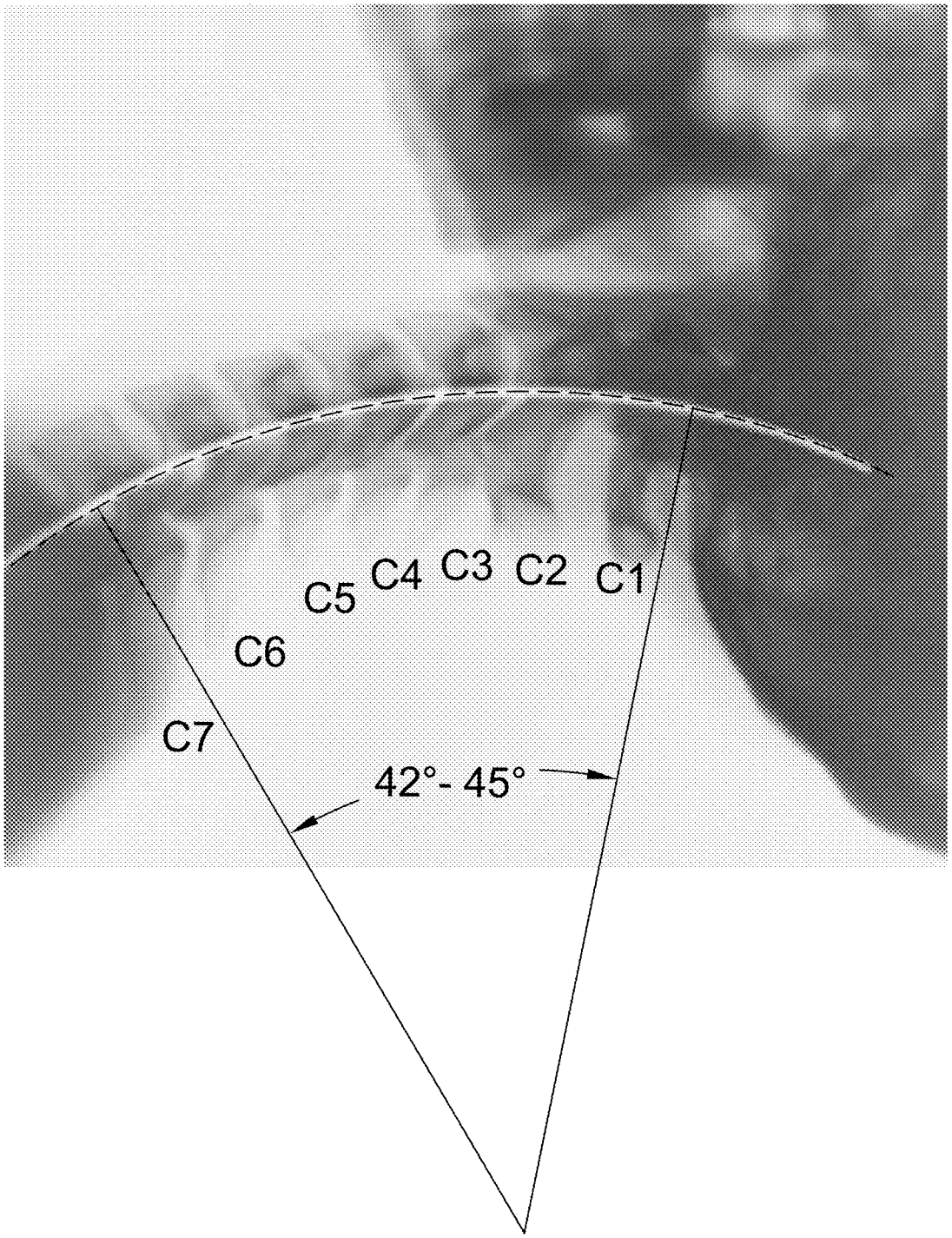
FIG. 12 depicts the normal range of cervical curvature.

Referring now to FIG. 12, there is depicted the normal healthy curvature of the cervical section ranging from about 42° to about 45° between C1 and C7 of the vertebrae.

Figure 13:
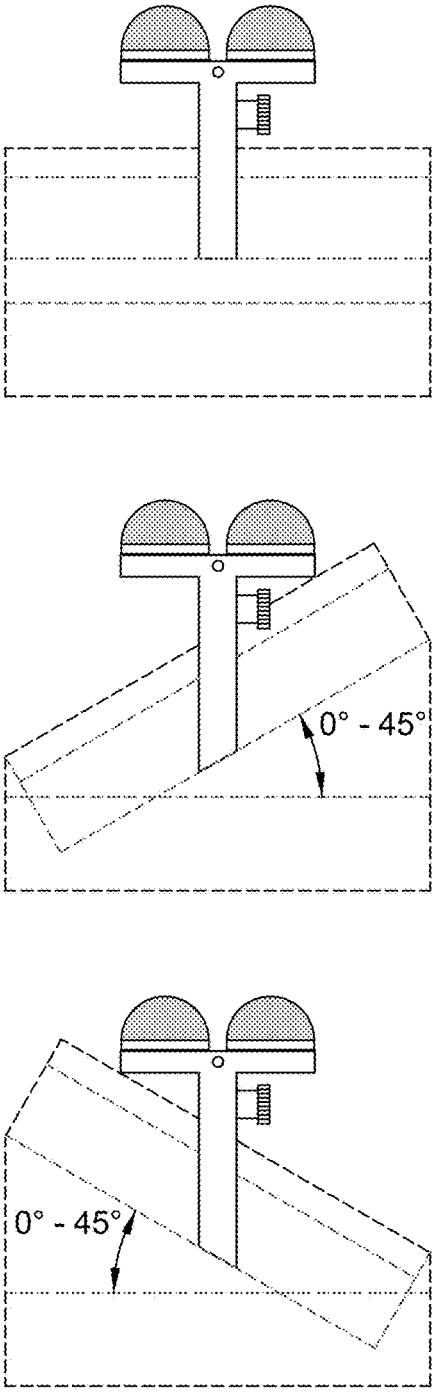
FIG. 13 depicts the thoracic section in various lateral angular positions.

Referring now to FIG. 13, the base or the thoracic section may be laterally adjusted to accommodate users requiring a lateral tilt. FIG. 13 provides, in one instance, the thoracic section being substantially parallel to the base. In another instance, the thoracic section is tilted or laterally adjusted to the right or to the left in relation to the massage heads, from 0° to about 45°. In another alternative, the padded area may be adjustable in length and width (not shown).

Figure 14:
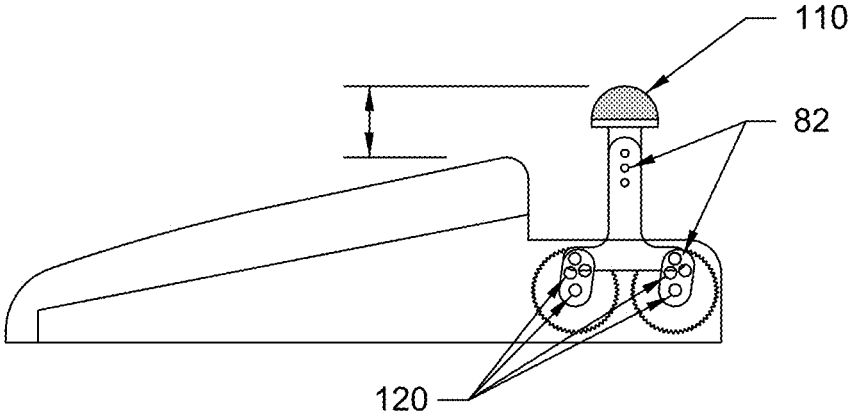
FIG. 14 depicts the differential height variant of the apparatus.

Referring now to FIG. 14, there is depicted a relationship between the thoracic section and the cervical section of the apparatus. The thoracic section is pivotal at one end thereof, the end opposite the cervical section. Pivoting the thoracic section will adjust the height between the thoracic section end proximate the cervical section and the top of the massage head of the cervical section. This distance relationship is termed a differential height variant. The differential height variant may be adjusted through the angle of the thoracic section and/or the height adjustment features of the cervical section including the height adjustment settings on the height adjustment element 82 and/or the adjustable drive pins 120. This allows manipulation of the cervical curvature for various chiropractic adjustments and for wide variety of body types and cervical curvatures.

Figure 15:
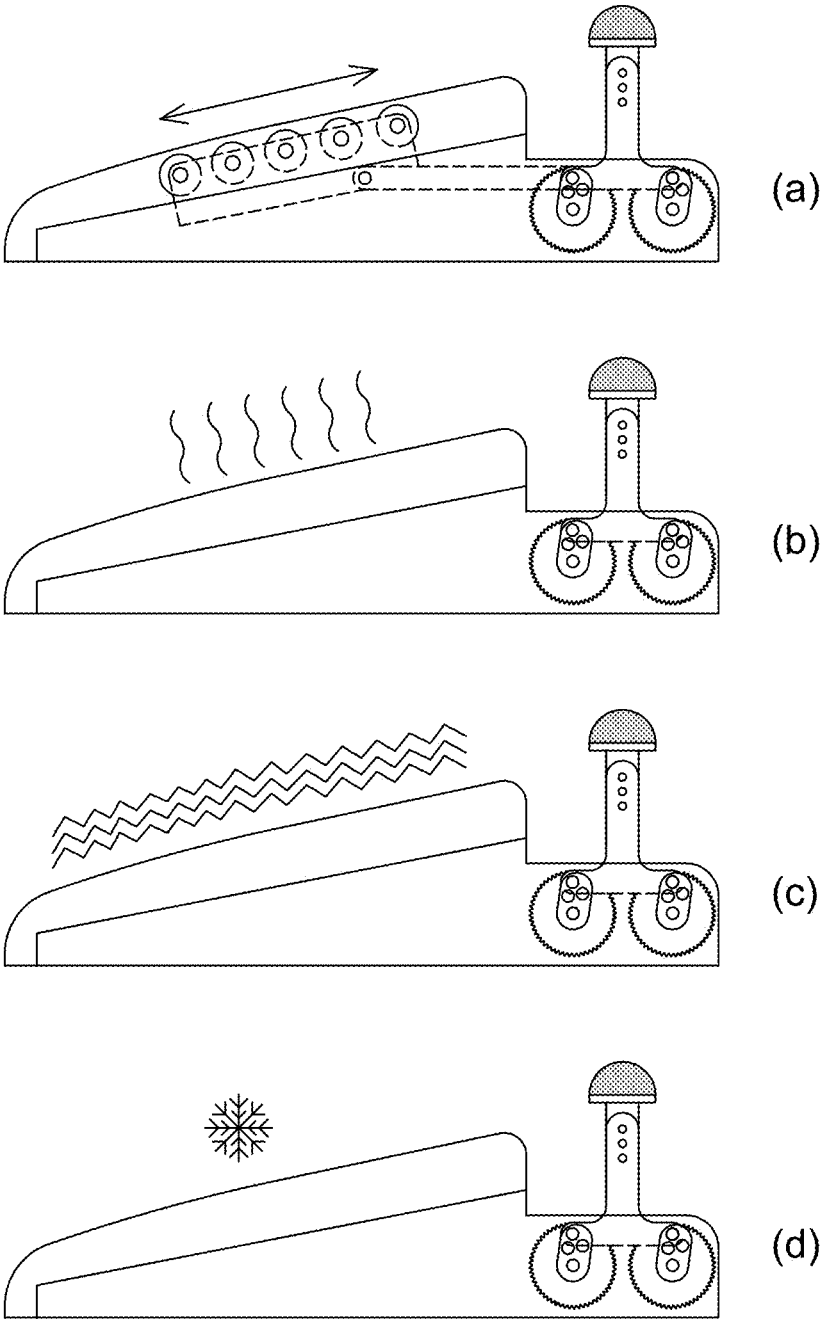
FIG. 15 depicts variants of the thoracic section.

Referring now to FIG. 15, there is depicted variants of the pliability of the thoracic section of the apparatus. The thoracic section may be a foam pad that may be constructed from a variety of materials including, but not limited to, open and closed cell foam, polyurethane foam of varying density including low, medium and high density (from 3 to 10 lbs. per cubic foot), compressed polyester, polyester fiberfill, expandable and integral skin, self-skinning polyurethane foam, gel foam, memory foam and combinations thereof. In one alternative, the foam may also comprise antimicrobial properties. The thoracic section may also comprise a covering material to cover the pliable area, including, but not limited to, cloth, leather, artificial leather, vinyl, microfiber, natural materials, man-made materials and combinations thereof. In one alternative, the covering material may also comprise antimicrobial properties. In FIG. 15, the thoracic section is shown to include add-ons such as massage rollers (a) that move in conjunction with the arc movement of the massage heads, a heated option (b), a vibratory option (c) and a cooling option (d).

Figure 16:
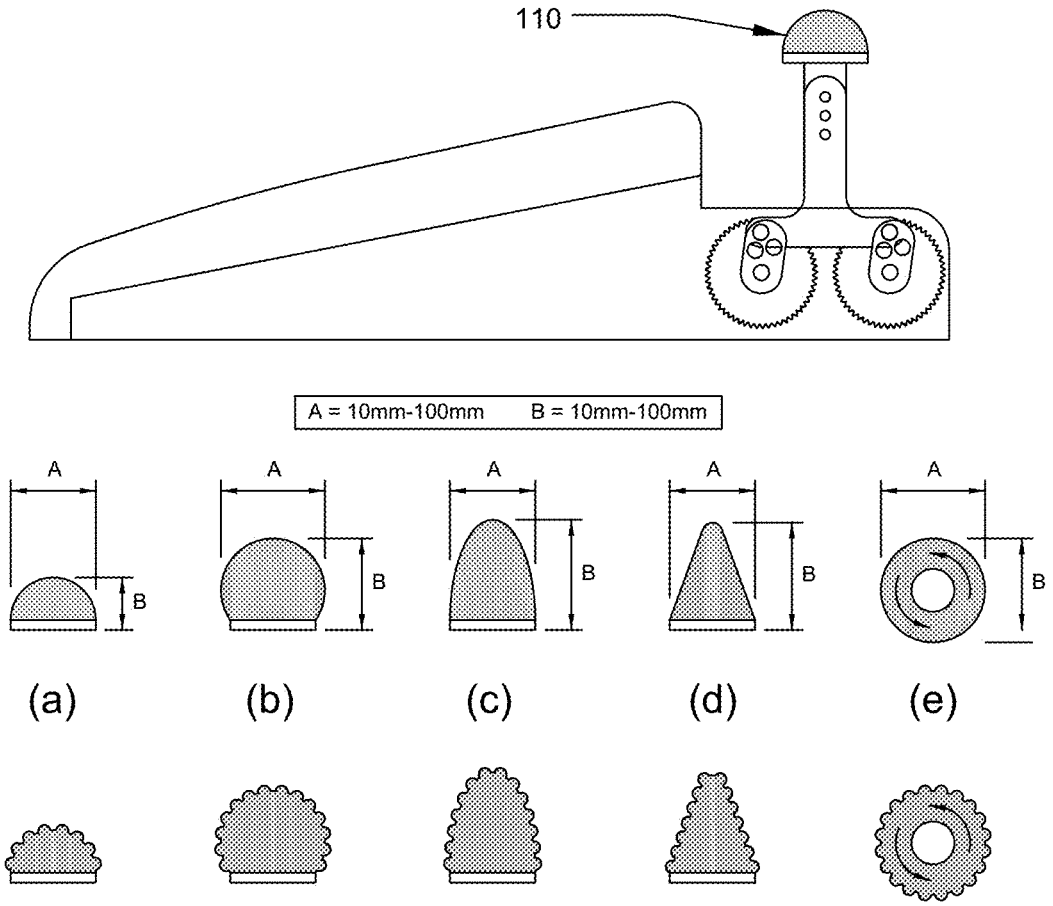
FIG. 16 depicts variants of the head of the apparatus.

Referring now to FIG. 16, there is depicted variants of the massage head 110. The material of the massage head may include, but not limited to, silicon, rubber, inflatable material, polyurethane, plastic, cell foam, gel, gel foam and combinations thereof.

Figure 17:
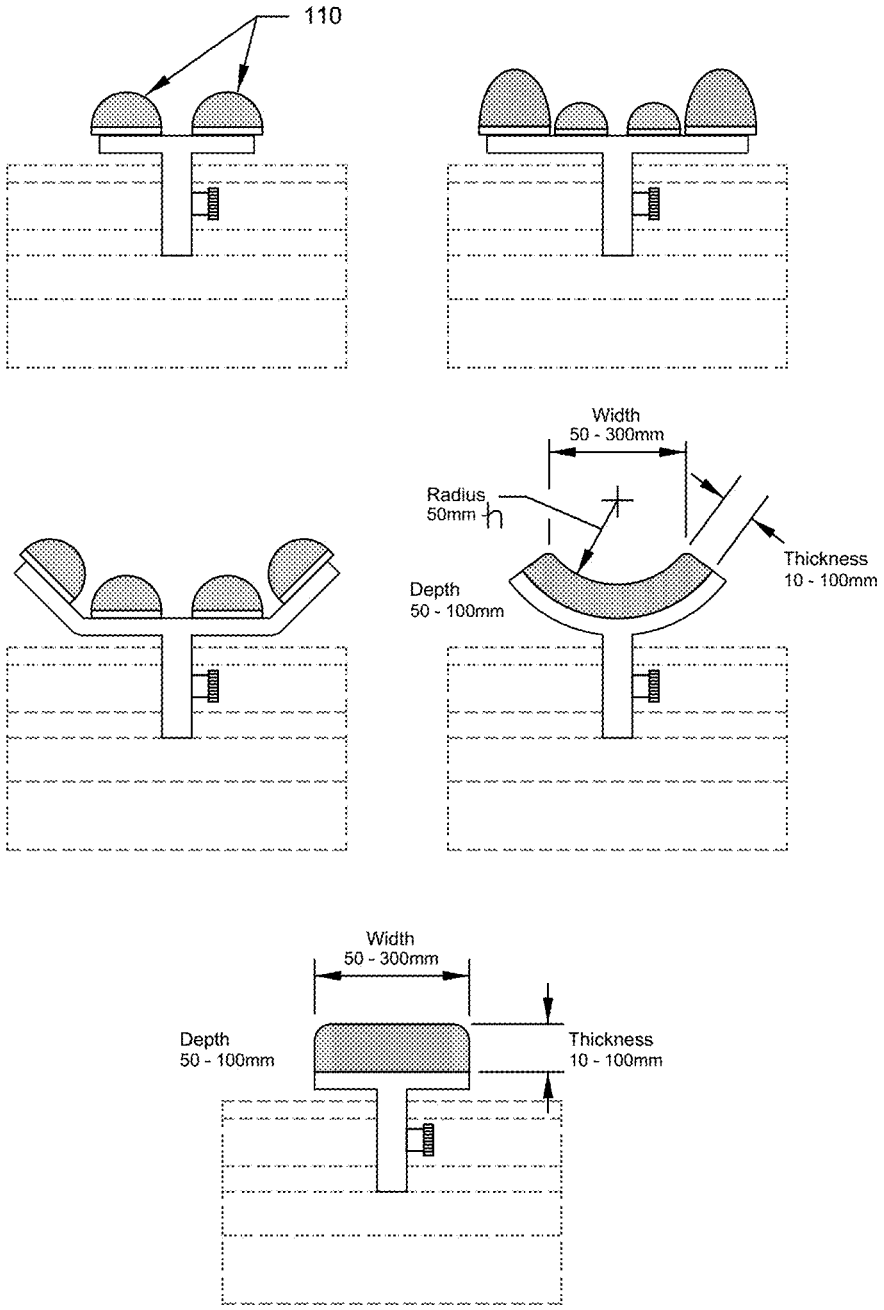
FIG. 17 depicts an end view of variants of the head of the apparatus.

The massage head may be sized and shaped according to the desired result of the user, including a width and height from about 10 mm to about 100 mm. In terms of shape, the head may be a hemisphere, a spherical cap (spherical dome), a hemiellipsoid, a cone, a roller wheel and combinations thereof. Some examples include, but are not limited to, radial (a), spherical (b), elliptical (c), conical (d), roller wheel (e) and textured versions thereof (depicted below each example). In one alternative, the head has a textured surface. In one alternative, the head may have a Shore Hardness from about 10 to about 100. The number of massage heads may range from one to a plurality. As best seen in FIG. 17, there is depicted various configurations of massage heads 110 including varying the number of massage heads to combining heads of different shapes and heads arranged in a cradle like fashion to a u-shaped cradle massage head and a horizontal cradle shaped massage head. The u-shaped cradle massage head and a horizontal cradle shaped massage head each having a width in the range of from 50 to 300 mm, a depth in the range of from 50 to 100 mm and a thickness in the range of from 10 to 100 mm. The u-shaped cradle may be made of metal, plastic or other durable material to support a padded section that may be made of material and hardness for the massage head as described herein.

Figure 18:
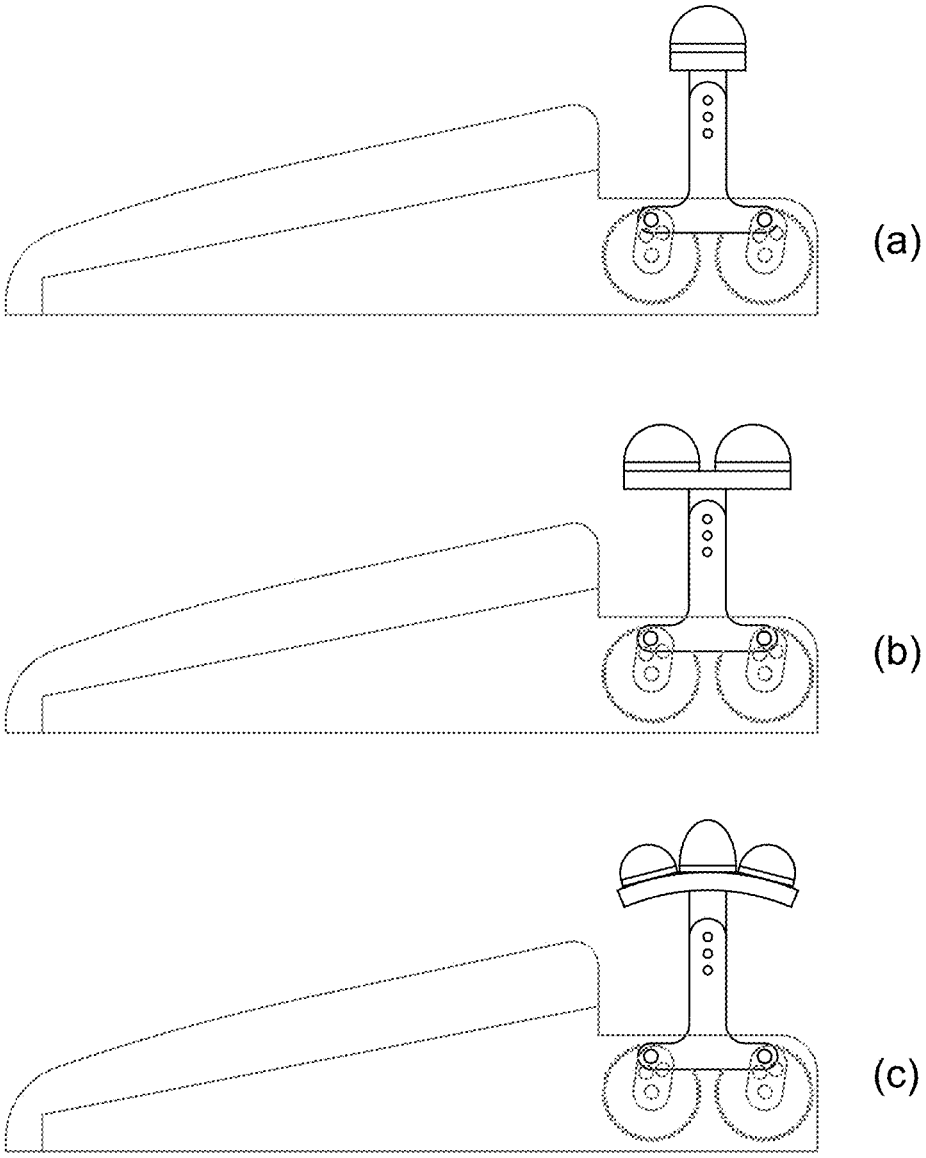
FIG. 18 depicts a side view of variants of the head of the apparatus.

As best seen in FIG. 18, there is depicted the cervical section with various configurations of the massage head from a side view. In one alternative, one can see a single row massage head (a), a double row massage head (b) and a triple row massage head (c).

Figure 19:
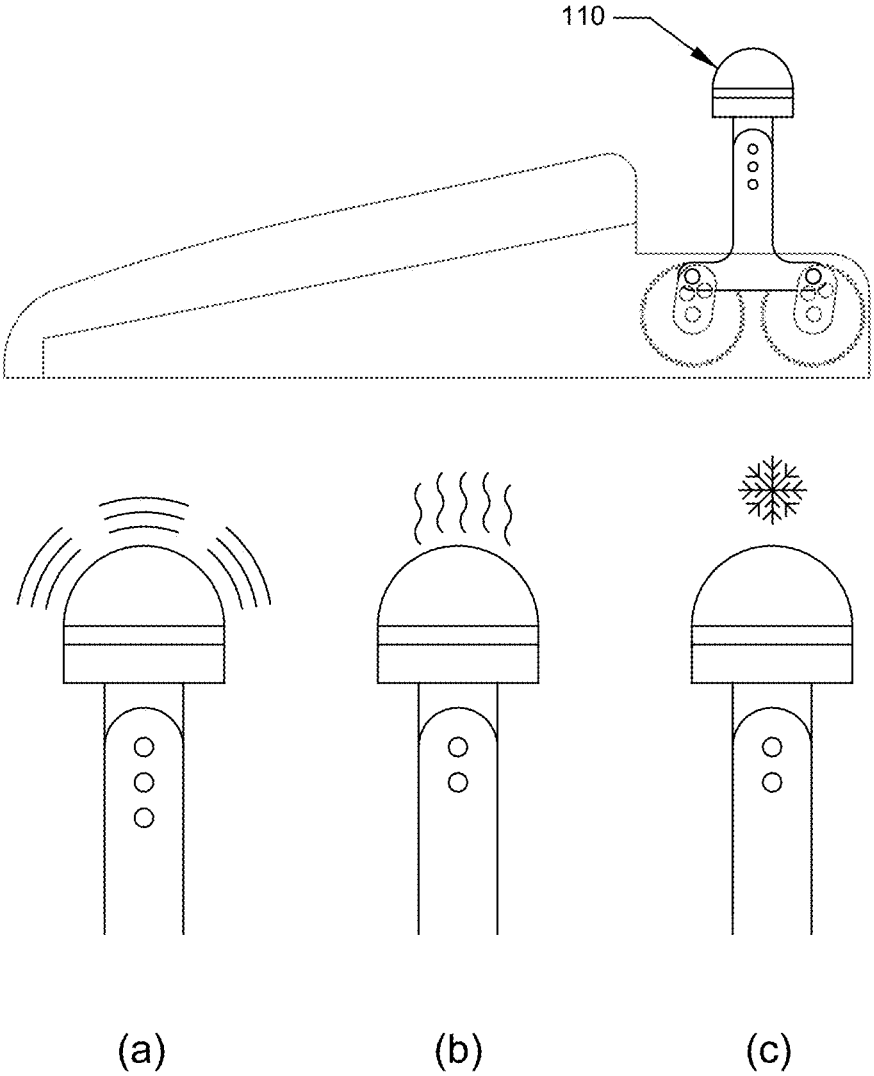
FIG. 19 depicts further variants of the head of the apparatus.

As best seen in FIG. 19, there is depicted massage head 100 add-ons such as a massage head with vibration characteristics (a), heating (b) and cooling (c) characteristics, including infrared characteristics, electrostimulation (not shown) and rolling characteristics (not shown).

Figure 20:
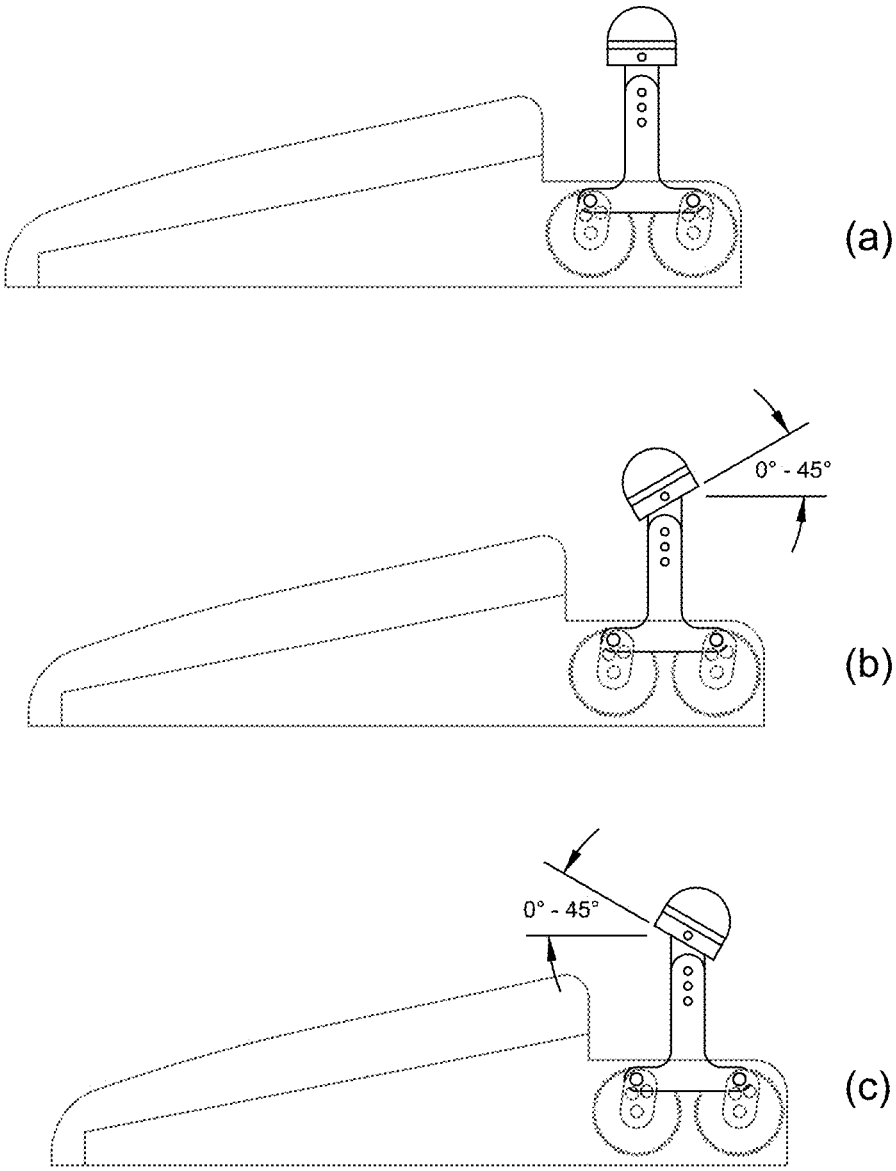
FIG. 20 depicts longitudinal articulation of the head of the apparatus.
Figure 21:
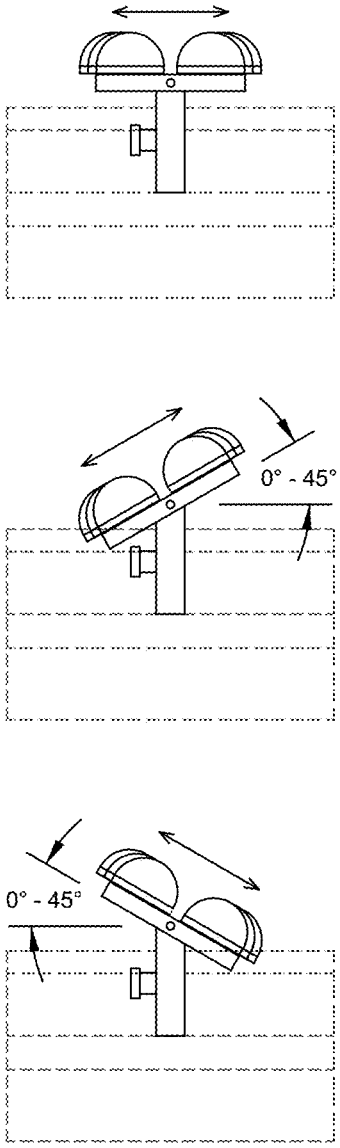
FIG. 21 depicts transverse articulation of the head of the apparatus.

As best seen in FIG. 20 the adjustable spread bar supports and holds the massage heads (or neck contact points) in place. The massage heads are articulated in that each may be adjusted angularly in the longitude as per FIG. 20 such as zero longitudinal articulation (a), positive (b) and negative (c) longitudinal articulation, and laterally as per FIG. 21 with zero transverse articulation (a), left (b) and right (c) transverse articulation. The massage heads being laterally adjustable.

Figure 22:
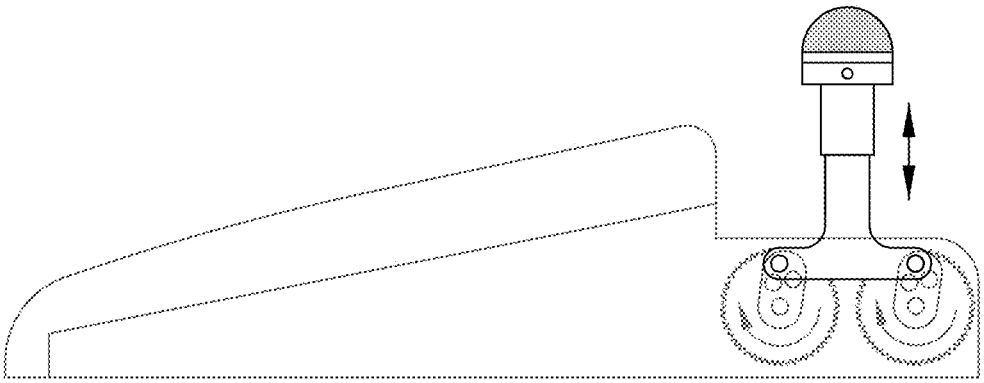
FIG. 22 depicts vertical piston action of the head of the apparatus.

As best seen in FIG. 22, the vertical link arm which links the adjustable spreader bar and massage head to the large gears, may have a piston like feature for reciprocating motion of the massage head, and in one alternative, rapid, short, hammer and/or tapping motions of the massage head while the device is in operation. This action mimics the action and resulting effect(s) of a chiropractor hammer or Arthrostim™.

Figure 23:
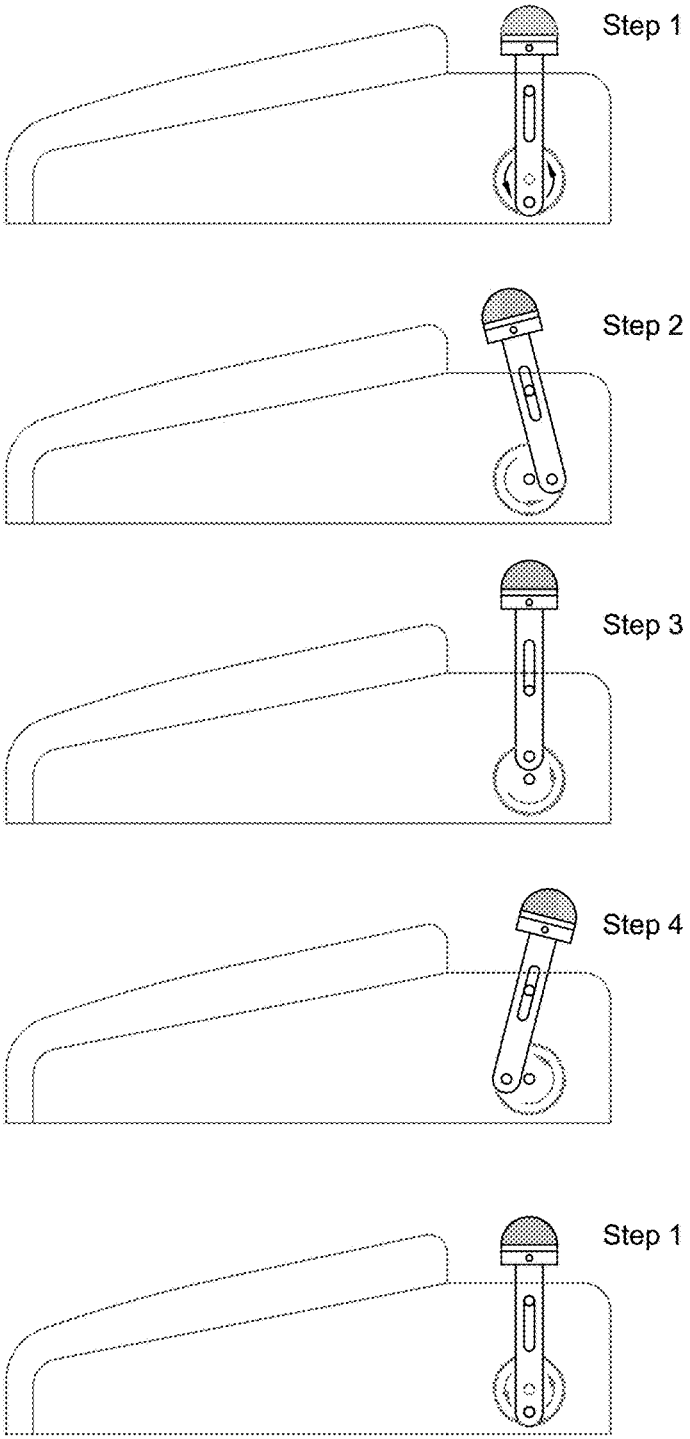
FIG. 23 depicts angular piston action of the head of the apparatus.

As best seen in FIG. 23, an alternative drive mechanism may be used to produce a similar rotational arc path, wherein a complete cycle is depicted from an initial position (step 1) to a final position (step 4) and back to initial position (step 1). In one alternative, there can be a single vertical link arm or multiple vertical link arms that may be adjustable in length. In another alternative, the vertical link arm may be hinged or bent to accommodate various angular positions of the massage head. In another alternative, the vertical link arm has a cover to minimize contact between the user and the massage heads.

Figure 24:
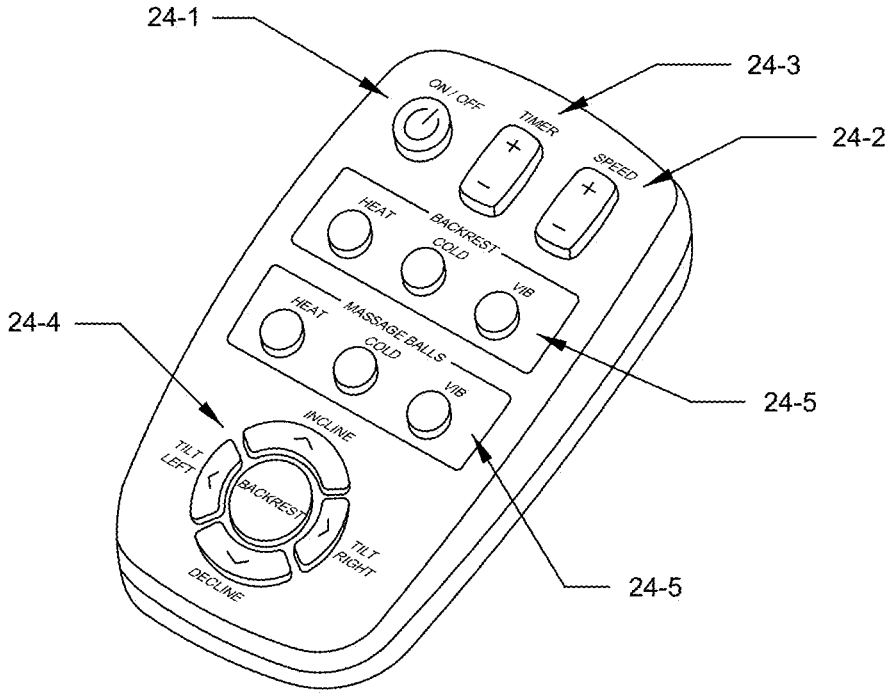
FIG. 24 depicts a remote control.

As best seen in FIG. 24, a remote control is depicted to control various aspects of the apparatus, such as motor control 24-1, speed 24-2, time of operation 24-3, angular adjustments 24-4, heat, cold, vibratory 24-5 and the like.

Figure 25:
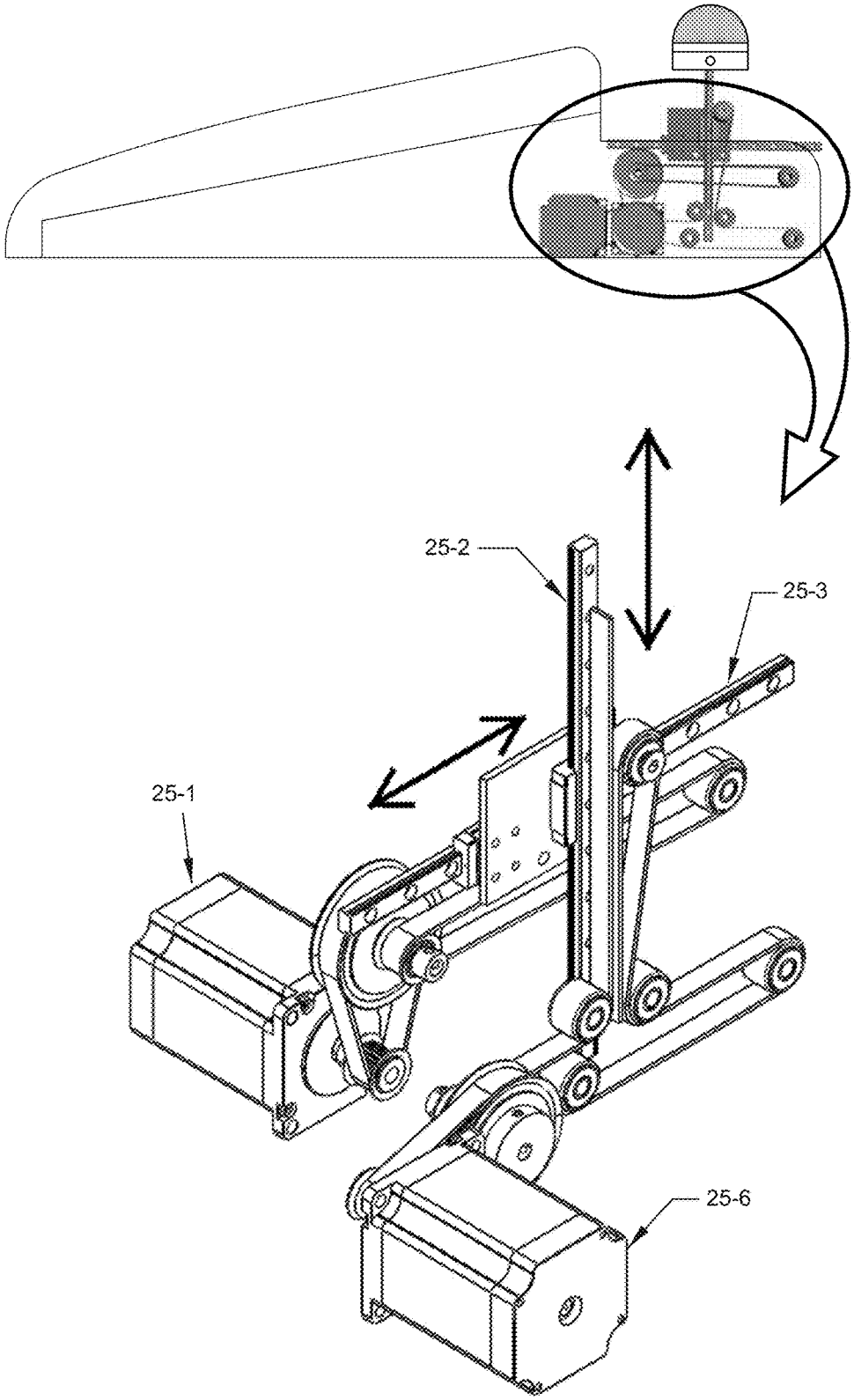
FIG. 25 depicts a dual motor alternative.

As best seen in FIG. 25, a two motor alternative is depicted wherein a horizontal motion control motor 25-1 and a vertical motion control motor 25-6 are incorporated to provide independent control of vertical and horizontal arc path of the massage head. Horizontal motor 25-1 provides horizontal movement along the horizontal guide rail 25-3 for the horizontal movement component of the massage head and vertical motor 25-6 provides vertical movement along the vertical guide rail 25-2 for the vertical movement component of the massage head resulting in varying arc paths of the massage head as best seen in FIG. 6

As many changes can be made to the above without departing from the scope thereof; it is intended that all matter contained herein be considered illustrative and not in a limiting sense.

The invention claimed is:

1. An apparatus for manipulating/correcting the cervical curvature of a user, said apparatus comprising a top, a bottom, a first end, a second end, a first side and a second side, wherein:

proximate said top, a thoracic section for receiving at least one region of said user, said at least one region selected from the group consisting of: a upper back region of said user, and a thoracic region of the user; said thoracic section being fixed proximate the first end and movable proximate said second end of said apparatus;

proximate said top, a cervical section for receiving a cervical curve region of the user; said cervical section being selected from the group consisting of fixed and movable, wherein when said cervical section is movable, said cervical section is movable in at least one of the following:

with a traction path in at least one of the following planes: vertical, horizontal, and combinations thereof; or movable in an arc-like motion along the vertical plane;

wherein said cervical section further comprises at least one head;

wherein said at least one head is movable in a curve like motion; and wherein said curve like motion is generated by at least two motors, each motor being connected to at least one pulley connected to said at least one head via a link arm, a belt and horizontal and vertical guide rails, wherein each of said at least two motors independently controlling horizontal and vertical curve like motion, whereby each of said at least two independently controlled motors result in a variety of arc path patterns corresponding to varying physiological needs and outcomes.

2. The apparatus of claim 1 wherein said apparatus is movable in relation to the fixed end of the thoracic section to the cervical section between an angle of from 0 degrees to about 90 degrees relative to the bottom of the apparatus and the horizon.

3. The apparatus of claim 1 wherein said cervical section further comprises at least two heads.

4. The apparatus of claim 3 wherein said at least two heads are spaced apart from each other along a horizontal plane resulting in a horizontal distance between each of said at least two heads.

5. The apparatus of claim 4 wherein said horizontal distance between each of said at least two heads is adjustable from a first position to a second position.

6. The apparatus of claim 3 wherein said at least two heads are movable in a curve like motion.

7. The apparatus of claim 6 wherein said curve like motion oscillates from one end of said cervical section to the other end of said cervical section and from said other end to said one end.

8. The apparatus of claim 6 wherein said curve like motion is generated by a motor connected to at least one gear connected to said at least one head via a link arm and a drive arm.

9. The apparatus of claim 3 wherein said at least two heads each comprise a shape selected from the group consisting of a hemisphere, a spherical cap (spherical dome), a hemiellipsoid, a cone, a roller wheel and combinations thereof.

10. The apparatus of claim 9 wherein said at least two heads each have a textured surface.

11. The apparatus of claim 3 wherein said at least two heads each further comprise characteristics to further stimulate and or massage the cervical region selected from the group consisting of vibration, temperature adjustment (heat/cold), electro-stimulation, rollers and combinations thereof.

12. The apparatus of claim 3 wherein said at least two heads each further comprise a degree of articulation between 0° to about 45°, selected from longitudinal articulation, lateral (or transverse) articulation and combinations thereof.

13. The apparatus of claim 3 wherein said at least two heads each further comprise a piston allowing for a tapping or hammer like action during the arc-like motion thereof.

14. The apparatus of claim 1 wherein said at least one head is adjustable in height from a first position to a second position.

15. The apparatus of claim 1 wherein said curve like motion oscillates from one end of the cervical section to the other end of the cervical section and from said other end to said one end.

16. The apparatus of claim 1 wherein said curve like motion is generated by said at least two motors connected to at least one gear connected to said at least one head via a link arm and a drive arm.

17. The apparatus of claim 1 for use with a user in a position between a supine position and a Fowler's position.

18. The apparatus of claim 1 wherein said at least one head comprises a shape selected from the group consisting of a hemisphere, a spherical cap (spherical dome), a hemiellipsoid, a cone, a roller wheel and combinations thereof.

19. The apparatus of claim 18 wherein said at least one head has a textured surface.

20. The apparatus of claim 1 wherein said at least one head is a u-shaped cradle.

21. The apparatus of claim 1 wherein said at least one head is made of material comprising silicon, rubber, inflatable material, polyurethane, plastic, cell foam, gel, gel foam and combinations thereof.

22. The apparatus of claim 1 wherein said at least one head further comprises characteristics to further stimulate and or massage the cervical region selected from the group consisting of vibration, temperature adjustment (heat/cold), electro-stimulation, rollers and combinations thereof.

23. The apparatus of claim 1 wherein said at least one head further comprises a degree of articulation between 0° to about 45°, selected from longitudinal articulation, lateral (or transverse) articulation and combinations thereof.

24. The apparatus of claim 1 wherein said at least one head further comprise a piston allowing for a tapping or hammer like action during the arc-like motion thereof.

25. The apparatus of claim 1 further comprising at least one headband connectable to said apparatus proximate said cervical section of said apparatus.

26. An apparatus according to claim 1 to correct posture, relieve cervical tension, impingement, migraines and headaches and restore the cervical arc; the apparatus comprising a back wedge with a rotating massager that aids in compression of cervical spine lordosis, and includes continuous passive range of motion that is targeted at the suboccipital triangle.

27. An apparatus for manipulating/correcting the cervical curvature of a user, said apparatus comprising a top, a bottom, a first end, a second end, a first side and a second side, wherein:

proximate said top, a thoracic section for receiving at least one region of said user, said at least one region selected from the group consisting of: a upper back region of said user, and a thoracic region of the user; said thoracic section being fixed proximate the first end and movable proximate said second end of said apparatus;

proximate said top, a cervical section for receiving a cervical curve region of the user; said cervical section being selected from the group consisting of fixed and movable, wherein when said cervical section is movable, said cervical section is movable in at least one of the following:

with a traction path in at least one of the following planes: vertical, horizontal, and combinations thereof; or movable in an arc-like motion along the vertical plane;

wherein said cervical section further comprises at least two heads;

wherein said at least two heads are movable in a curve like motion; and wherein said curve like motion is generated by at least two motors, each motor being connected to at least one pulley connected to said at least one head via a link arm, a drive arm and a belt, wherein each of said at least two motors independently controlling horizontal and vertical curve like motion, whereby each of said at least two independently controlled motors result in a variety of arc path patterns corresponding to varying physiological needs and outcomes.

* * * * *